US011477601B2

(12) United States Patent
Robinson et al.

(10) Patent No.: US 11,477,601 B2
(45) Date of Patent: Oct. 18, 2022

(54) METHODS AND DEVICES FOR BASS MANAGEMENT

(71) Applicant: Dolby Laboratories Licensing Corporation, San Francisco, CA (US)

(72) Inventors: Charles Q. Robinson, Piedmont, CA (US); Mark R. P. Thomas, Walnut Creek, CA (US); Michael J. Smithers, Kareela (AU)

(73) Assignee: DOLBY LABORATORIES LICENSING CORPORATION, San Francisco, CA (US)

( * ) Notice: Subject to any disclaimer, the term of this patent is extended or adjusted under 35 U.S.C. 154(b) by 0 days.

(21) Appl. No.: 17/286,313

(22) PCT Filed: Oct. 16, 2019

(86) PCT No.: PCT/US2019/056523
§ 371 (c)(1),
(2) Date: Apr. 16, 2021

(87) PCT Pub. No.: WO2020/081674
PCT Pub. Date: Apr. 23, 2020

(65) Prior Publication Data

US 2021/0345060 A1 Nov. 4, 2021

Related U.S. Application Data

(60) Provisional application No. 62/746,468, filed on Oct. 16, 2018.

(51) Int. Cl.
*H04S 7/00* (2006.01)

(52) U.S. Cl.
CPC ..... *H04S 7/307* (2013.01)

(58) Field of Classification Search
None
See application file for complete search history.

(56) References Cited

U.S. PATENT DOCUMENTS 8,238,576 B2 8/2012 Cooper
9,055,367 B2 6/2015 Li
9,319,789 B1 4/2016 Nielsen
(Continued)

FOREIGN PATENT DOCUMENTS

CN 102724605 A 10/2012
CN 103517183 B 2/2017
(Continued)

OTHER PUBLICATIONS

Fang, Y. et al "Small-Sized Loudspeaker Equalization Based SVD-Krylov Model Reduction and Virtual Bass Enhancement".
(Continued)

*Primary Examiner* — James K Mooney

(57) ABSTRACT

Some disclosed methods involve multi-band bass management. Some such examples may involve applying multiple high-pass and low-pass filter frequencies for the purpose of bass input management. Some disclosed methods treat at least some low-frequency signals as audio objects that can be panned. Some disclosed methods involve panning low and high frequencies separately. Following high-pass rendering, a power audit may determine a low-frequency deficit factor that is to be reproduced by subwoofers or other low-frequency-capable loudspeakers.

15 Claims, 14 Drawing Sheets

(56) References Cited

U.S. PATENT DOCUMENTS

| | | | |
|---|---|---|---|
| 9,516,406 | B2 | 12/2016 | Fromel |
| 9,712,916 | B2 | 7/2017 | Katsianos |
| 9,723,425 | B2 | 8/2017 | Fischer |
| 9,729,969 | B2 | 8/2017 | Risberg |
| 9,781,510 | B2 | 10/2017 | Brannmark |
| 9,838,826 | B2 | 12/2017 | Tsingos |
| 2006/0280311 | A1 | 12/2006 | Beckinger |
| 2017/0048640 | A1 | 2/2017 | Dressler |

FOREIGN PATENT DOCUMENTS

| | | | |
|---|---|---|---|
| JP | 6155132 | | 6/2017 |
| RU | 2602346 | C2 | 11/2016 |
| RU | 2617553 | C2 | 4/2017 |
| RU | 2641481 | C2 | 1/2018 |
| RU | 2667630 | C2 | 9/2018 |
| WO | 2007106872 | A2 | 9/2007 |
| WO | 2014204911 | | 12/2014 |

OTHER PUBLICATIONS

Hirvonen, T. et al "Extended Bass Management Methods for Cost-Efficient Immersive Audio Reproduction in Digital Cinema" AES presented at the 140th Convention, Jun. 4-7, 2016, Paris, France.

Horn, R.A. et al "Norms for Vectors and Matrices", Ch. 5 in Matrix Analysis, Cambridge, England, Cambridge University Press, 1990.

Pulkki, Ville "Compensating Displacement of Amplitude-Panned Virtual Sources" (Audio Engineering Society) Jun. 1, 2002.

Raatgever, J. "On the Binaural Processing of Stimuli with Different Interaural Phase Relations" Dissertation, 1980.

700

METHODS AND DEVICES FOR BASS MANAGEMENT

CROSS-REFERENCE TO RELATED APPLICATIONS

This application claims the benefit of priority to U.S. Provisional Patent Application No. 62/746,468 filed 16 Oct. 2018, which is hereby incorporated by reference in its entirety.

TECHNICAL FIELD

This disclosure relates to the processing and reproduction of audio data. In particular, this disclosure relates to bass management for audio data.

BACKGROUND

Bass management is a method used in audio systems to efficiently reproduce the lowest frequencies in an audio program. The design or location of main loudspeakers may not support sufficient, efficient, or uniform low-frequency sound production. In such cases a wideband signal may be split into two or more frequency bands, with the low frequencies directed to loudspeakers that are capable of reproducing low-frequency audio without undue distortion.

SUMMARY

Various audio processing methods, including but not limited to bass management methods, are disclosed herein. Some such methods may involve receiving audio data, which may include a plurality of audio objects. The audio objects may include audio data and associated metadata. The metadata may include audio object position data. Some methods may involve receiving reproduction speaker layout data that may include an indication of one or more reproduction speakers in the reproduction environment and an indication of a location of the one or more reproduction speakers within the reproduction environment. The reproduction speaker layout data may, in some examples, include low-frequency-capable (LFC) loudspeaker location data corresponding to one or more LFC reproduction speakers of the reproduction environment and main loudspeaker location data corresponding to one or more main reproduction speakers of the reproduction environment. In some examples, the reproduction speaker layout data may include an indication of a location of one or more groups of reproduction speakers within the reproduction environment.

Some such methods may involve rendering the audio objects into speaker feed signals based, at least in part, on the associated metadata and the reproduction speaker layout data. Each speaker feed signal may correspond to one or more reproduction speakers within a reproduction environment. Some such methods may involve applying a high-pass filter to at least some of the speaker feed signals, to produce high-pass-filtered speaker feed signals, and applying a low-pass filter to the audio data of each of a plurality of audio objects to produce low-frequency (LF) audio objects. Some methods may involve panning the LF audio objects based, at least in part, on the LFC loudspeaker location data, to produce LFC speaker feed signals. Some such methods may involve outputting the LFC speaker feed signals to one or more LFC loudspeakers of the reproduction environment and providing the high-pass-filtered speaker feed signals to one or more main reproduction speakers of the reproduction environment.

According to some implementations, a method may involve decimating the audio data of one or more of the audio objects before, or as part of, the application of a low-pass filter to the audio data of each of the plurality of the audio objects. Some methods may involve determining a signal level of the audio data of the audio objects, comparing the signal level to a threshold signal level and applying the one or more low-pass filters only to audio objects for which the signal level of the audio data is greater than or equal to the threshold signal level. Some methods may involve calculating a power deficit based, at least in part, on the gain and high-pass filter(s) characteristics and determining the low-pass filter based, at least in part, on the power deficit.

In some examples, applying a high-pass filter to at least some of the speaker feed signals may involve applying two or more different high-pass filters. According to some implementations, applying a high-pass filter to at least some of the speaker feed signals may involve applying a first high-pass filter to a first plurality of the speaker feed signals to produce first high-pass-filtered speaker feed signals and applying a second high-pass filter to a second plurality of the speaker feed signals to produce second high-pass-filtered speaker feed signals. The first high-pass filter may, in some examples, be configured to pass a lower range of frequencies than the second high-pass filter.

Some methods may involve receiving first reproduction speaker performance information regarding a first set of main reproduction speakers and receiving second reproduction speaker performance information regarding a second set of main reproduction speakers. In some such examples, the first high-pass filter may correspond to the first reproduction speaker performance information and the second high-pass filter may correspond to the second reproduction speaker performance information. Providing the high-pass-filtered speaker feed signals to the one or more main reproduction speakers may involve providing the first high-pass-filtered speaker feed signals to the first set of main reproduction speakers and providing the second high-pass-filtered speaker feed signals to the second set of main reproduction speakers.

In some implementations, the metadata may include an indication of whether to apply a high-pass filter to speaker feed signals corresponding to a particular audio object of the audio objects. According to some examples, producing the LF audio objects may involve applying two or more different filters.

In some instances, producing the LF audio objects may involve applying a low-pass filter to at least some of the audio objects, to produce first LF audio objects. The low-pass filter may be configured to pass a first range of frequencies. Some such methods may involve applying a high-pass filter to the first LF audio objects to produce second LF audio objects. The high-pass filter may be configured to pass a second range of frequencies that is a mid-LF range of frequencies. Panning the LF audio objects based, at least in part, on the LFC loudspeaker location data, to produce LFC speaker feed signals may involve producing first LFC speaker feed signals by panning the first LF audio objects and producing second LFC speaker feed signals by panning the second LF audio objects.

According to some examples, producing the LF audio objects may involve applying a low-pass filter to a first plurality of the audio objects, to produce first LF audio objects. The low-pass filter may be configured to pass a first range of frequencies. Some such methods may involve applying a bandpass filter to a second plurality of the audio objects to produce second LF audio objects. The bandpass filter may be configured to pass a second range of frequencies that is a mid-LF range of frequencies. Panning the LF audio objects based, at least in part, on the LFC loudspeaker location data, to produce LFC speaker feed signals may involve producing first LFC speaker feed signals by panning the first LF audio objects and producing second LFC speaker feed signals by panning the second LF audio objects.

In some examples, receiving the LFC loudspeaker location data may involve receiving non-subwoofer location data indicating a location of each of a plurality of non-subwoofer reproduction speakers capable of reproducing audio data in the second range of frequencies. Producing the second LFC speaker feed signals may involve panning at least some of the second LF audio objects based, at least in part, on the non-subwoofer location data to produce non-subwoofer speaker feed signals. Some such methods also may involve providing the non-subwoofer speaker feed signals to one or more of the plurality of non-subwoofer reproduction speakers of the reproduction environment.

According to some implementations, receiving the LFC loudspeaker location data may involve receiving mid-subwoofer location data indicating a location of each of a plurality of mid-subwoofer reproduction speakers capable of reproducing audio data in the second range of frequencies. In some such implementations, producing the second LFC speaker feed signals may involve panning at least some of the second LF audio objects based, at least in part, on the mid-subwoofer location data to produce mid-subwoofer speaker feed signals. Some such methods also may involve providing the mid-subwoofer speaker feed signals to one or more of the plurality of mid-subwoofer reproduction speakers of the reproduction environment.

Some or all of the methods described herein may be performed by one or more devices according to instructions (e.g., software) stored on one or more non-transitory media. Such non-transitory media may include memory devices such as those described herein, including but not limited to random access memory (RAM) devices, read-only memory (ROM) devices, etc. Accordingly, various innovative aspects of the subject matter described in this disclosure can be implemented in a non-transitory medium having software stored thereon. The software may, for example, include instructions for controlling at least one device to process audio data. The software may, for example, be executable by one or more components of a control system such as those disclosed herein. The software may, for example, include instructions for performing one or more of the methods disclosed herein.

At least some aspects of the present disclosure may be implemented via apparatus. For example, one or more devices may be configured for performing, at least in part, the methods disclosed herein. In some implementations, an apparatus may include an interface system and a control system. The interface system may include one or more network interfaces, one or more interfaces between the control system and a memory system, one or more interfaces between the control system and another device and/or one or more external device interfaces. The control system may include at least one of a general purpose single- or multi-chip processor, a digital signal processor (DSP), an application specific integrated circuit (ASIC), a field programmable gate array (FPGA) or other programmable logic device, discrete gate or transistor logic, or discrete hardware components. Accordingly, in some implementations the control system may include one or more processors and one or more non-transitory storage media operatively coupled to the one or more processors. The control system may be configured for performing some or all of the methods disclosed herein.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale. Like reference numbers and designations in the various drawings generally indicate like elements.

BRIEF DESCRIPTION OF THE DRAWINGS

Like reference numbers and designations in the various drawings indicate like elements.

DESCRIPTION OF EXAMPLE EMBODIMENTS

The following description is directed to certain implementations for the purposes of describing some innovative aspects of this disclosure, as well as examples of contexts in which these innovative aspects may be implemented. However, the teachings herein can be applied in various different ways. Moreover, the described embodiments may be implemented in a variety of hardware, software, firmware, etc. For example, aspects of the present application may be embodied, at least in part, in an apparatus, a system that includes more than one device, a method, a computer program product, etc. Accordingly, aspects of the present application may take the form of a hardware embodiment, a software embodiment (including firmware, resident software, microcodes, etc.) and/or an embodiment combining both software and hardware aspects. Such embodiments may be referred to herein as a "circuit," a "module" or "engine." Some aspects of the present application may take the form of a computer program product embodied in one or more non-transitory media having computer readable program code embodied thereon. Such non-transitory media may, for example, include a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. Accordingly, the teachings of this disclosure are not intended to be limited to the implementations shown in the figures and/or described herein, but instead have wide applicability.

Figure 1:
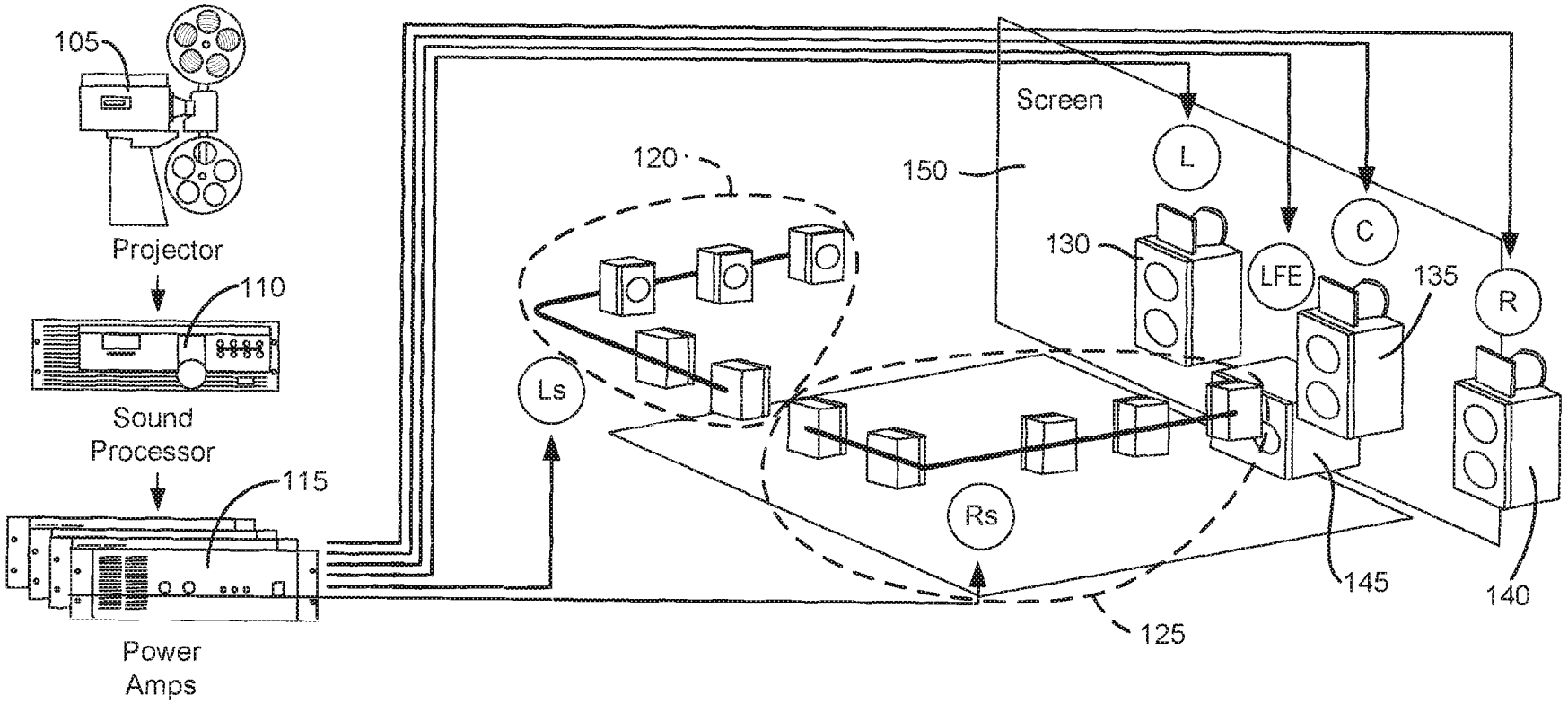
FIG. 1 shows an example of a reproduction environment having a Dolby Surround 5.1 configuration.

FIG. 1 shows an example of a reproduction environment having a Dolby Surround 5.1 configuration. Dolby Surround 5.1 was developed in the 1990s, but this configuration is still widely deployed in cinema sound system environments. A projector 105 may be configured to project video images, e.g. for a movie, on the screen 150. Audio reproduction data may be synchronized with the video images and processed by the sound processor 110. The power amplifiers 115 may provide speaker feed signals to speakers of the reproduction environment 100.

The Dolby Surround 5.1 configuration includes left surround array 120, right surround array 125, each of which is gang-driven by a single channel. The Dolby Surround 5.1 configuration also includes separate channels for the left screen channel 130, the center screen channel 135 and the right screen channel 140. A separate channel for the subwoofer 145 is provided for low-frequency effects (LFE).

Figure 2:
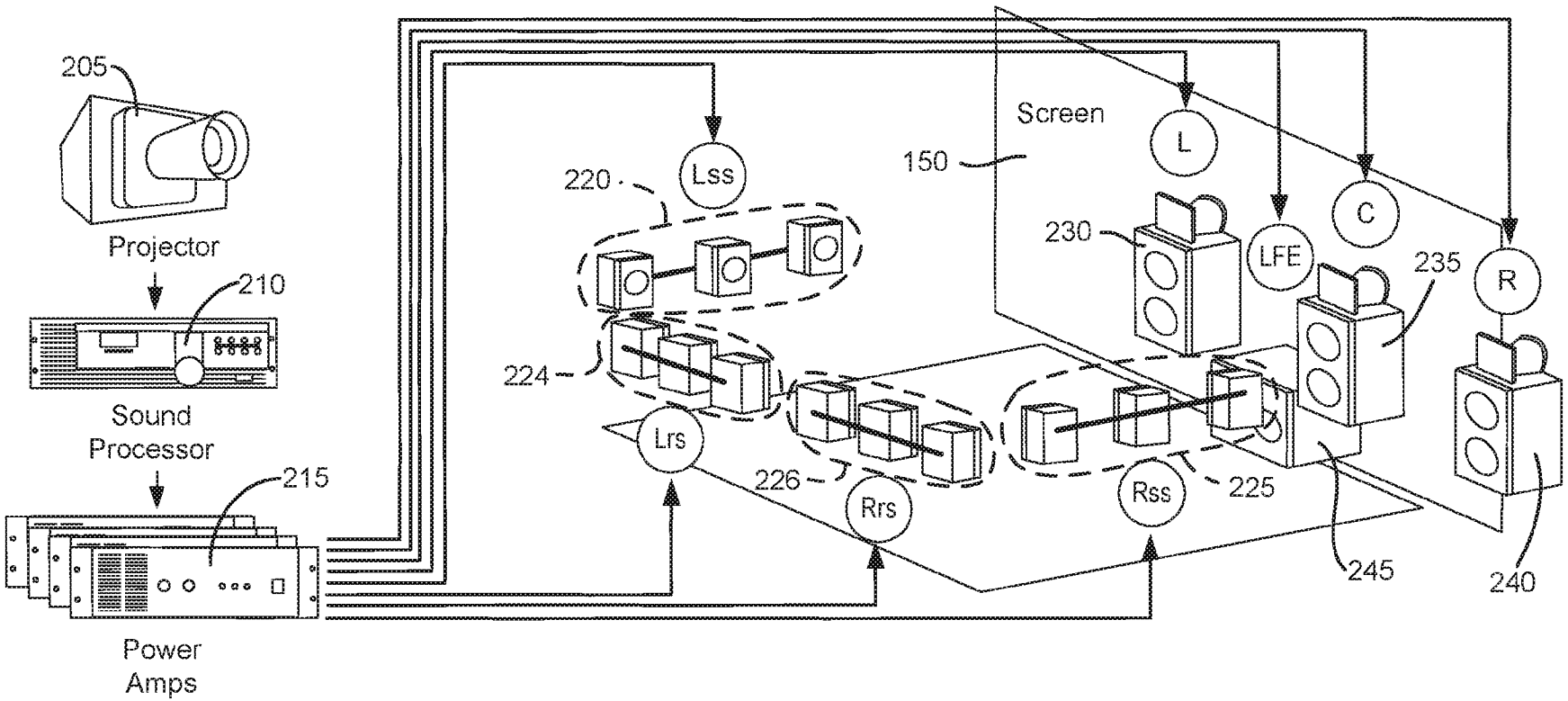
FIG. 2 shows an example of a reproduction environment having a Dolby Surround 7.1 configuration.

In 2010, Dolby provided enhancements to digital cinema sound by introducing Dolby Surround 7.1. FIG. 2 shows an example of a reproduction environment having a Dolby Surround 7.1 configuration. A digital projector 205 may be configured to receive digital video data and to project video images on the screen 150. Audio reproduction data may be processed by the sound processor 210. The power amplifiers 215 may provide speaker feed signals to speakers of the reproduction environment 200.

The Dolby Surround 7.1 configuration includes the left side surround array 220 and the right side surround array 225, each of which may be driven by a single channel Like Dolby Surround 5.1, the Dolby Surround 7.1 configuration includes separate channels for the left screen channel 230, the center screen channel 235, the right screen channel 240 and the subwoofer 245. However, Dolby Surround 7.1 increases the number of surround channels by splitting the left and right surround channels of Dolby Surround 5.1 into four zones: in addition to the left side surround array 220 and the right side surround array 225, separate channels are included for the left rear surround speakers 224 and the right rear surround speakers 226. Increasing the number of surround zones within the reproduction environment 200 can significantly improve the localization of sound.

In an effort to create a more immersive environment, some reproduction environments may be configured with increased numbers of speakers, driven by increased numbers of channels. Moreover, some reproduction environments may include speakers deployed at various elevations, some of which may be above a seating area of the reproduction environment.

Figure 3:
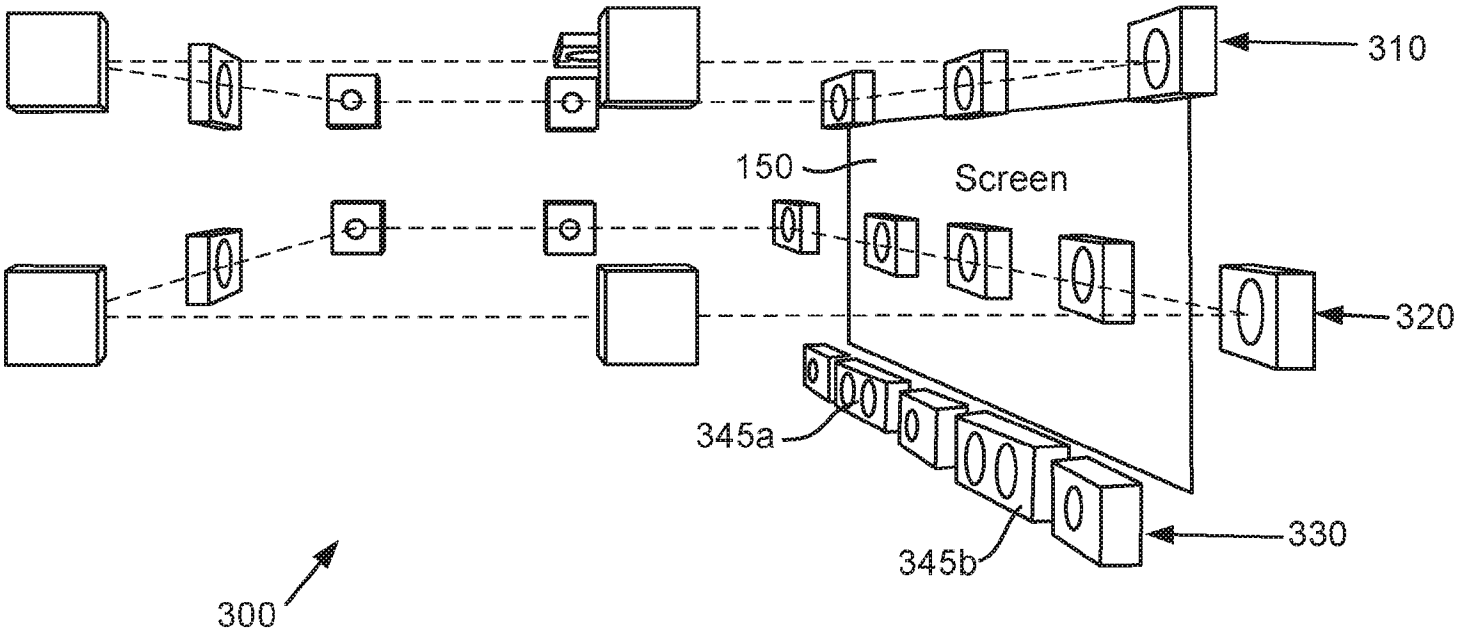
FIG. 3 shows an example of a reproduction environment having a Hamasaki 22.2 surround sound configuration.

FIG. 3 shows an example of a reproduction environment having a Hamasaki 22.2 surround sound configuration. Hamasaki 22.2 was developed at NHK Science & Technology Research Laboratories in Japan as the surround sound component of Ultra High Definition Television. Hamasaki 22.2 provides 24 speaker channels, which may be used to drive speakers arranged in three layers. Upper speaker layer 310 of reproduction environment 300 may be driven by 9 channels. Middle speaker layer 320 may be driven by 10 channels. Lower speaker layer 330 may be driven by 5 channels, two of which are for the subwoofers 345*a* and 345*b*.

Accordingly, the modern trend is to include not only more speakers and more channels, but also to include speakers at differing heights. As the number of channels increases and the speaker layout transitions from a 2D array to a 3D array, the tasks of positioning and rendering sounds becomes increasingly difficult.

As used herein with reference to virtual reproduction environments such as the virtual reproduction environment 404, the term "speaker zone" generally refers to a logical construct that may or may not have a one-to-one correspondence with a reproduction speaker of an actual reproduction environment. For example, a "speaker zone location" may or may not correspond to a particular reproduction speaker location of a cinema reproduction environment. Instead, the term "speaker zone location" may refer generally to a zone of a virtual reproduction environment. In some implementations, a speaker zone of a virtual reproduction environment may correspond to a virtual speaker, e.g., via the use of virtualizing technology such as Dolby Headphone,™ (sometimes referred to as Mobile Surround™), which creates a virtual surround sound environment in real time using a set of two-channel stereo headphones. In GUI 400, there are seven speaker zones 402*a* at a first elevation and two speaker zones 402*b* at a second elevation, making a total of nine speaker zones in the virtual reproduction environment 404. In this example, speaker zones 1-3 are in the front area 405 of the virtual reproduction environment 404. The front area 405 may correspond, for example, to an area of a cinema reproduction environment in which a screen 150 is located, to an area of a home in which a television screen is located, etc.

Figure 4A:
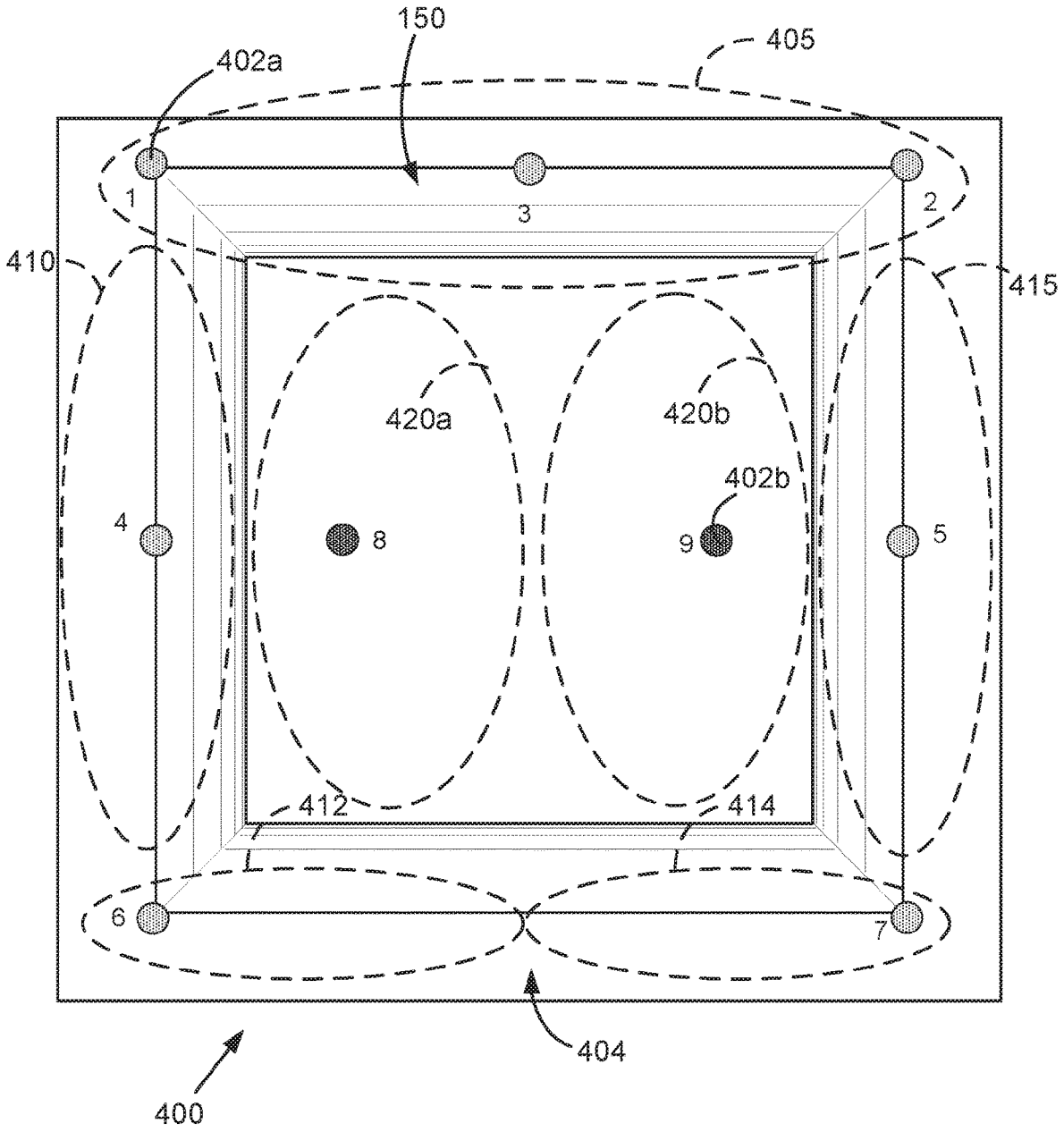
FIG. 4A shows an example of a graphical user interface (GUI) that portrays speaker zones at varying elevations in a virtual reproduction environment.

Here, speaker zone 4 corresponds generally to speakers in the left area 410 and speaker zone 5 corresponds to speakers in the right area 415 of the virtual reproduction environment 404. Speaker zone 6 corresponds to a left rear area 412 and speaker zone 7 corresponds to a right rear area 414 of the virtual reproduction environment 404. Speaker zone 8 corresponds to speakers in an upper area 420*a* and speaker zone 9 corresponds to speakers in an upper area 420*b*, which may be a virtual ceiling area such as an area of the virtual ceiling 520 shown in FIGS. 5D and 5E. Accordingly, and as described in more detail below, the locations of speaker zones 1-9 that are shown in FIG. 4A may or may not correspond to the locations of reproduction speakers of an actual reproduction environment. Moreover, other implementations may include more or fewer speaker zones and/or elevations.

In various implementations described herein, a user interface such as GUI 400 may be used as part of an authoring tool and/or a rendering tool. In some implementations, the authoring tool and/or rendering tool may be implemented via software stored on one or more non-transitory media. The authoring tool and/or rendering tool may be implemented (at least in part) by hardware, firmware, etc., such as the logic system and other devices described below with reference to FIG. 21. In some authoring implementations, an associated authoring tool may be used to create metadata for associated audio data. The metadata may, for example, include data indicating the position and/or trajectory of an audio object in a three-dimensional space, speaker zone constraint data, etc. The metadata may be created with respect to the speaker zones 402 of the virtual reproduction environment 404, rather than with respect to a particular speaker layout of an actual reproduction environment. A rendering tool may receive audio data and associated metadata, and may compute audio gains and speaker feed signals for a reproduction environment. Such audio gains and speaker feed signals may be computed according to an amplitude panning process, which can create a perception that a sound is coming from a position P in the reproduction environment. For example, speaker feed signals may be provided to reproduction speakers 1 through N of the reproduction environment according to the following equation:

$$x_i(t) = g_i x(t),\ i = 1, \ldots N \qquad \text{(Equation 1)}$$

In Equation 1, $x_i(t)$ represents the speaker feed signal to be applied to speaker i, $g_i$ represents the gain factor of the corresponding channel, x(t) represents the audio signal and t represents time. The gain factors may be determined, for example, according to the amplitude panning methods described in Section 2, pages 3-4 of V. Pulkki, *Compensating Displacement of Amplitude-Panned Virtual Sources* (Audio Engineering Society (AES) International Conference on Virtual, Synthetic and Entertainment Audio), which is hereby incorporated by reference. In some implementations, the gains may be frequency dependent. In some implementations, a time delay may be introduced by replacing x(t) by $x(t-\Delta t)$.

In some rendering implementations, audio reproduction data created with reference to the speaker zones 402 may be mapped to speaker locations of a wide range of reproduction environments, which may be in a Dolby Surround 5.1 configuration, a Dolby Surround 7.1 configuration, a Hamasaki 22.2 configuration, or another configuration. For example, referring to FIG. 2, a rendering tool may map audio reproduction data for speaker zones 4 and 5 to the left side surround array 220 and the right side surround array 225 of a reproduction environment having a Dolby Surround 7.1 configuration. Audio reproduction data for speaker zones 1, 2 and 3 may be mapped to the left screen channel 230, the right screen channel 240 and the center screen channel 235, respectively. Audio reproduction data for speaker zones 6 and 7 may be mapped to the left rear surround speakers 224 and the right rear surround speakers 226.

Figure 4B:
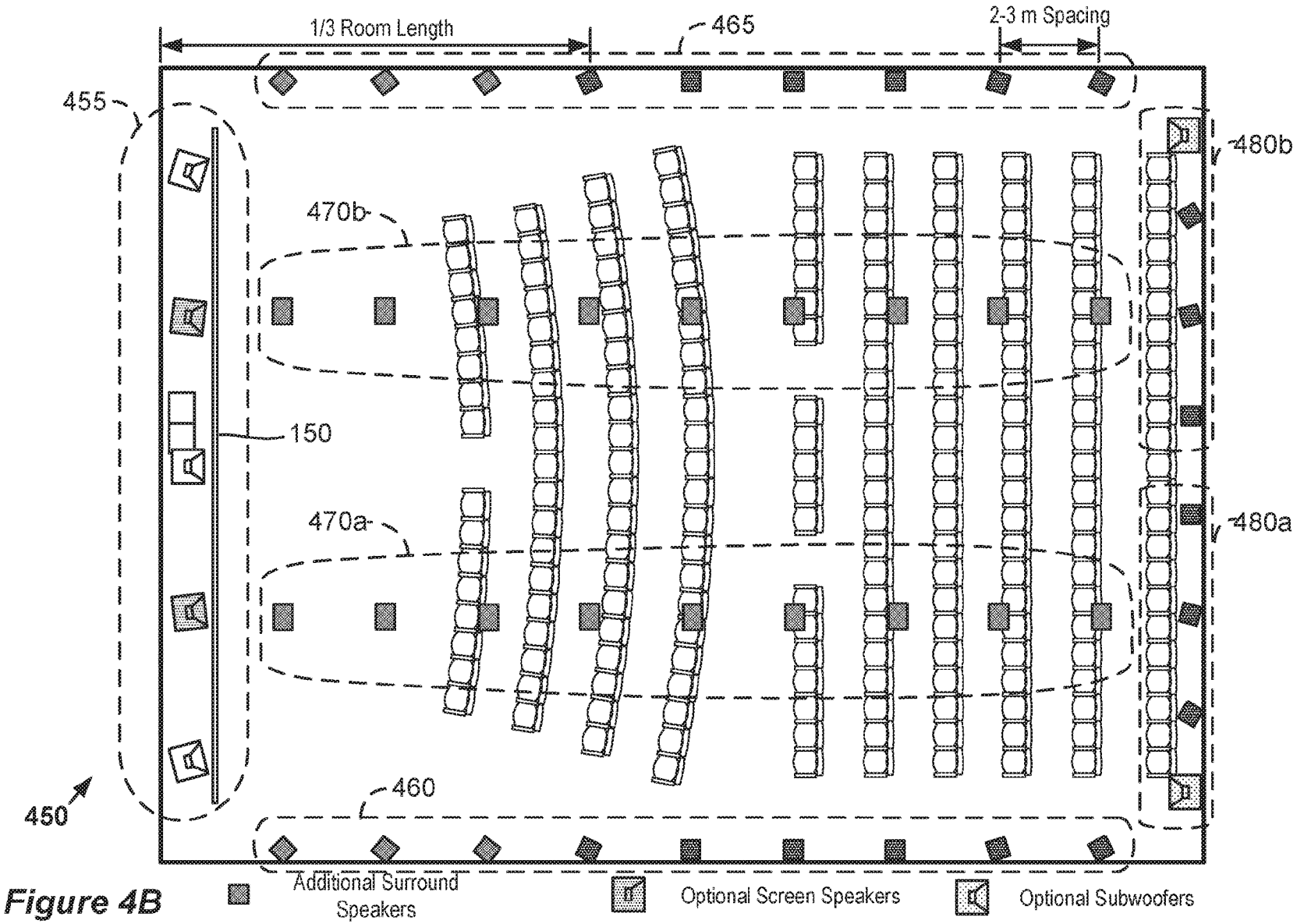
FIG. 4B shows an example of another reproduction environment.

FIG. 4B shows an example of another reproduction environment. In some implementations, a rendering tool may map audio reproduction data for speaker zones 1, 2 and 3 to corresponding screen speakers 455 of the reproduction environment 450. A rendering tool may map audio reproduction data for speaker zones 4 and 5 to the left side surround array 460 and the right side surround array 465 and may map audio reproduction data for speaker zones 8 and 9 to left overhead speakers 470*a* and right overhead speakers 470*b*. Audio reproduction data for speaker zones 6 and 7 may be mapped to left rear surround speakers 480*a* and right rear surround speakers 480*b*. However, in alternative implementations at least some speakers of the reproduction environment 450 may not be grouped as shown in FIG. 4B. Instead, some such implementations may involve panning audio reproduction data to individual side speakers, ceiling speakers, surround speakers and/or subwoofers. According to some such implementations, low-frequency audio signals corresponding to at least some audio objects may be panned to individual subwoofer locations and/or to the locations of other low-frequency-capable loudspeakers, such as the surround speakers that are illustrated in FIG. 4B.

In some authoring implementations, an authoring tool may be used to create metadata for audio objects. As used herein, the term "audio object" may refer to a stream of audio data, such as monophonic audio data, and associated metadata. The metadata typically indicates the two-dimensional (2D) or three-dimensional (3D) position of the audio object, rendering constraints as well as content type (e.g. dialog, effects, etc.). Depending on the implementation, the metadata may include other types of data, such as width data, gain data, trajectory data, etc. Some audio objects may be static, whereas others may move. Audio object details may be authored or rendered according to the associated metadata which, among other things, may indicate the position of the audio object in a three-dimensional space at a given point in time. When audio objects are monitored or played back in a reproduction environment, the audio objects may be rendered according to the positional metadata using the reproduction speakers that are present in the reproduction environment, rather than being output to a predetermined physical channel, as is the case with traditional channel-based systems such as Dolby 5.1 and Dolby 7.1.

Figure 5A:
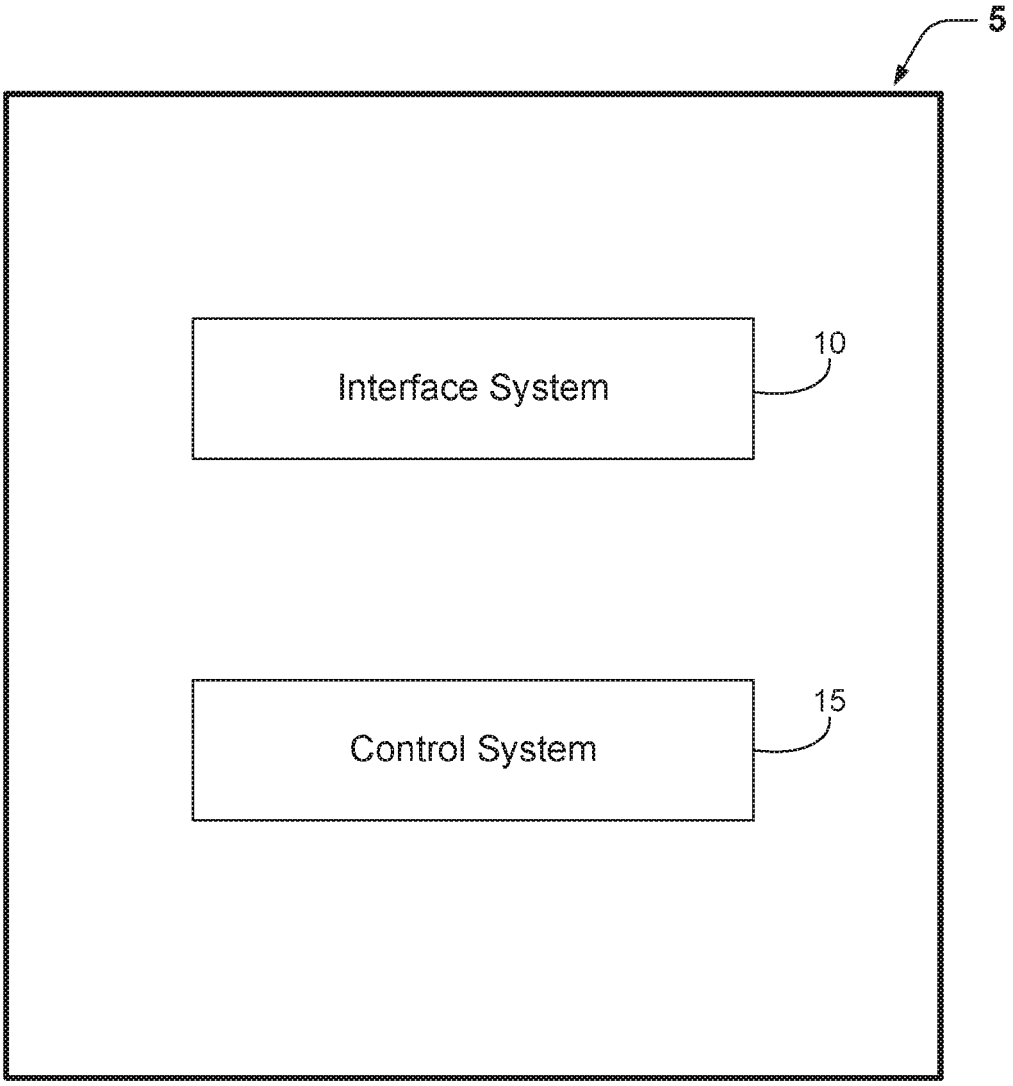
FIG. 5A is a block diagram that shows examples of components of an apparatus that may be configured to perform at least some of the methods disclosed herein.

FIG. 5A is a block diagram that shows examples of components of an apparatus that may be configured to perform at least some of the methods disclosed herein. In some examples, the apparatus 5 may be, or may include, a personal computer, a desktop computer or other local device that is configured to provide audio processing. In some examples, the apparatus 5 may be, or may include, a server. According to some examples, the apparatus 5 may be a client device that is configured for communication with a server, via a network interface. The components of the apparatus 5 may be implemented via hardware, via software stored on non-transitory media, via firmware and/or by combinations thereof. The types and numbers of components shown in FIG. 5A, as well as other figures disclosed herein, are merely shown by way of example. Alternative implementations may include more, fewer and/or different components.

In this example, the apparatus 5 includes an interface system 10 and a control system 15. The interface system 10 may include one or more network interfaces, one or more interfaces between the control system 15 and a memory system and/or one or more external device interfaces (such as one or more universal serial bus (USB) interfaces). In some implementations, the interface system 10 may include a user interface system. The user interface system may be configured for receiving input from a user. In some implementations, the user interface system may be configured for providing feedback to a user. For example, the user interface system may include one or more displays with corresponding touch and/or gesture detection systems. In some examples, the user interface system may include one or more microphones and/or speakers. According to some examples, the user interface system may include apparatus for providing haptic feedback, such as a motor, a vibrator, etc. The control system 15 may, for example, include a general purpose single- or multi-chip processor, a digital signal processor (DSP), an application specific integrated circuit (ASIC), a field programmable gate array (FPGA) or other programmable logic device, discrete gate or transistor logic, and/or discrete hardware components.

In some examples, the apparatus 5 may be implemented in a single device. However, in some implementations, the apparatus 5 may be implemented in more than one device. In some such implementations, functionality of the control system 15 may be included in more than one device. In some examples, the apparatus 5 may be a component of another device.

According to some bass management methods, the low-frequency information below some frequency threshold from some or all the main channels may be reproduced through one or more low-frequency-capable (LFC) loudspeakers. The frequency threshold may be referred herein as the "crossover frequency." The crossover frequency may be determined by the capability of the main loudspeaker(s) used to reproduce the audio channel Some main loudspeakers (which may be referred to herein as "non-Low Frequency Capable") could have LF signal routed to one or more LFC loudspeakers with a relatively high crossover frequency, such as 150 Hz. Some main loudspeakers (which may be referred to herein as "Restricted Low Frequency") could have LF signal routed to one or more LFC loudspeakers with a relatively low crossover frequency, such as 60 Hz.

Figure 5B:
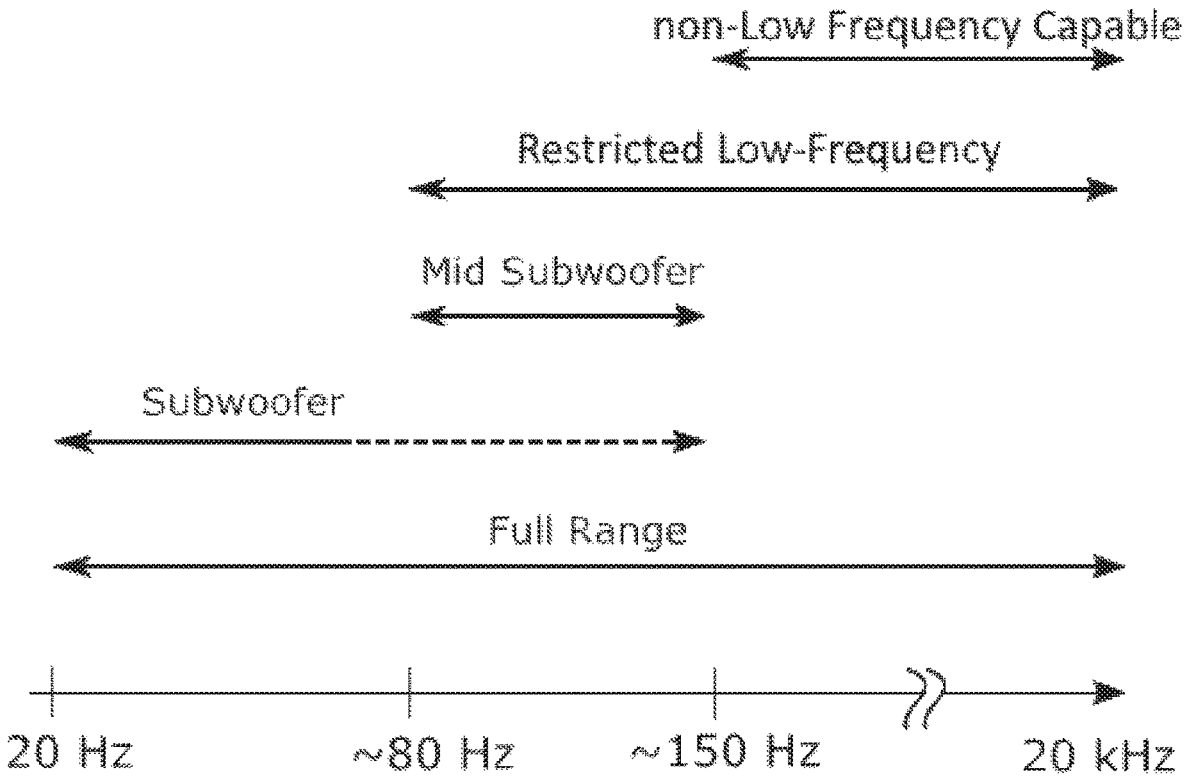
FIG. 5B shows some examples of loudspeaker frequency ranges.

FIG. 5B shows some examples of loudspeaker frequency ranges. As shown in FIG. 5B, some LFC loudspeakers may be Full Range loudspeakers, assigned to reproduction of all frequencies within the normal range of human hearing. Some LFC loudspeakers, such as subwoofers, may be dedicated to reproduction of audio below a frequency threshold. For example, some subwoofers may be dedicated to reproducing audio data that is less than a frequency such as 60 Hz or 80 Hz. In other examples, some subwoofers (which may be referred to herein as "mid-subwoofers") may be dedicated to reproducing audio data that is in a relatively higher range of frequencies, e.g., between approximately 60 Hz and 150 Hz, between 80 Hz and 160 Hz, etc. One or more mid-subwoofers can be used to bridge the gap in the frequency handling capabilities between the main loudspeaker(s) and subwoofer(s). One or more mid-subwoofers can be used bridge the gap in spatial resolution between the relatively dense configuration of main loudspeakers, and the relatively sparse configuration of subwoofers. As shown in FIG. 5B, for example, the frequency range indicated for the mid-subwoofer spans the frequency range between that of the subwoofer and that of the "non-Low Frequency Capable" type of main loudspeaker. However, the "Restricted Low-Frequency" type of main loudspeaker is capable of reproducing a range of frequencies that includes the mid-subwoofer range of frequencies.

Typically, the number of subwoofers is much smaller than the number of main channels. As a result, the spatial cues for the low-frequency (LF) information are diminished or distorted. For low frequencies in typical playback environments this spatial distortion is generally found to be perceptually acceptable or even imperceptible, because the human auditory system becomes less capable of detecting spatial cues as the sound frequency decreases, particularly for sound source localization.

There are many benefits to using bass management. The multiple loudspeakers used to reproduce the main channels (without the LF audio component) can be smaller, more easily installed, less intrusive, and lower-cost. The use of subwoofers or other LFC loudspeakers can also enable better control of the low-frequency sound. The LF audio can be processed independently of the rest of the program, and one or more LFC loudspeakers can be placed at locations that are optimal for bass reproduction, in some instances independent of the main loudspeakers. For example, the variation in frequency response from seat to seat within a listening area can be minimized.

A crossover, an electrical circuit or digital audio algorithm, may be used to split an audio signal into two (or more, if multiple crossovers are combined) audio signals, each covering a frequency band. A crossover is typically implemented by applying the input signal in parallel to a low-pass filter and a high-pass filter. The band boundaries, or crossover frequencies, are one parameter of crossover design. Complete separation into discrete frequency bands is not possible in practice; there is some overlap between the bands. The amount and the nature of the overlap is another parameter of crossover design. A common crossover frequency for bass management systems is 80 Hz, although lower and higher frequencies are often used based on system components and design goals.

Spatial audio programs can be created by panning and mixing multiple sound sources. As noted above, the individual sound sources (e.g. voice, trumpet, helicopter, etc.) in this context may be referred to as "audio objects." In traditional channel-based surround audio programs, the panning and mixing information is applied to the audio objects to create channel signals for a particular channel configuration (e.g., 5.1) prior to distribution.

With object-based audio programs, an audio scene may be defined by the individual audio objects, together with the associated pan and mix information for each object. The object-based program may then be distributed and rendered (converted to channel signals) at the destination, based on the pan and mix information, the playback equipment configuration (headphones, stereo, 5.1, 7.1 etc.), and potentially end-user controls (e.g., preferred dialog level) in the playback environment.

Object-based programs can enable additional control for bass management systems. The audio objects may, for example, be processed individually prior to generation of the channel-based mix.

Previously-implemented methods of bass management have shortcomings. One common problem involves bass build-up, which is also referred to as audio signal coupling. Multi-channel programs (channel-based distribution, or object-based distribution after rendering to channels) are affected by the electrical (analog processing) or mathematic (digital processing) interactions of the multiple audio signals prior to transduction to sound. Typical bass management systems (those with more source main loudspeakers than subwoofers) by necessity combine multiple low-frequency audio signals to generate the subwoofer audio signal(s) for playback. When combining channel signals for playback through a single loudspeaker, it is often assumed that the input channels are independent, and a power law (2-norm) is applied to model the acoustic coupling that would occur if the signals were played back through spaced loudspeakers. Channel-based bass management systems typically follow this convention when creating the low-frequency signal from multiple input channels.

However, if the audio signals are not independent (in other words, if the audio signals are fully or partially coherent) and summed (linear coupling) the resulting level is higher (louder) than if the signals were played back over discrete, spaced loudspeakers. In the case of bass management, coherent signals played back over the main, spaced loudspeakers will tend to have power-law acoustic coupling, while the low frequencies that are mixed (electrically or mathematically) will have linear coupling. This can result in "bass build-up" due to audio signal coupling.

Bass build-up can also be caused by acoustic coupling. Multi-loudspeaker sound reproduction systems are affected by the interaction of multiple sound sources within the acoustic space of the reproduction environment. The cumulative response for incoherent audio signals reproduced by different loudspeakers is frequently approximated using a power sum (2-norm) that is independent of frequency. The cumulative response for coherent audio signals reproduced by different loudspeakers is more complex. If the loudspeakers are widely spaced, and in free-field (a large, non-reverberant room, or outdoors), a power sum approximation holds well. Otherwise (for closely-spaced loudspeakers, for a smaller or reverberant room, etc.), as the coherent sound waves from two or more loudspeakers overlap and couple, constructive and destructive interference will occur in a manner that is dependent on the relative position of the sound sources, sound frequency, and location within the sound field. As with audio signal coupling, acoustic constructive interference (which occurs more for low frequencies and closely spaced loudspeakers) tends toward a linear sum (1-norm) of the sources rather than a power sum. This can result in acoustic "bass build-up" in the room. Channel-based bass management methods are limited in their ability to compensate for this effect. Typically this effect is ignored by bass management systems.

Bass management systems generally rely on the limitations of the auditory system to effectively discern the spatial information (for example, the location, width and/or diffusion) at very low frequencies. As the audio frequency increases, the loss of spatial information becomes increasingly apparent, and the artifacts become more noticeable and unacceptable.

Various disclosed implementations have been developed in view of the foregoing issues. Some disclosed examples may provide multi-band bass management methods. Some such examples may involve applying multiple high-pass and low-pass filter frequencies for the purpose of bass management. Some implementations also may involve applying one or more band-pass filters, to provide mid-LF speaker feed signals for "mid-subwoofers," for woofers or for non-subwoofer speakers that are capable of reproducing sound in a mid-LF range. The mid-LF range, or mid-LF ranges, may vary according to the particular implementation. In some examples, a mid-LF range passed by a bandpass filter may be approximately 60-140 Hz, 70-140 Hz, 80-140 Hz, 60-150 Hz, 70-150 Hz, 80-150 Hz, 60-160 Hz, 70-160 Hz, 80-160 Hz, 60-170 Hz, 70-170 Hz, 80-170 Hz, etc. The various capabilities of the main loudspeakers (e.g., lower power handling ceiling loudspeakers versus more capable side surround loudspeakers), the various capabilities of the target subwoofers (e.g., the subwoofer used for LFE channel playback versus surround subwoofers), the room acoustics, and other system characteristics can affect the optimal filter frequencies within the system. Some disclosed multi-band bass management methods can address some or all of these capabilities and properties, e.g., by providing one or more low-pass, band-pass and high-pass filters that correspond to the capabilities of loudspeakers in a reproduction environment.

According to some examples, a multi-band bass management method may involve using a different bass management loudspeaker configuration for each of a plurality of frequency bands. For example, if the number of available target loudspeakers increases for each bass management frequency band, then the spatial resolution of the signal may increase with frequency, thus minimizing introduction of perceived spatial artifacts.

Some implementations may involve using a different bass management processing method for each of a plurality of frequency bands. For example, some methods may use a different exponent (p-norm) for the level normalization in each band to better match the acoustic coupling that would occur without bass management. For the lowest frequencies, wherein acoustic coupling tends toward linear summation, an exponent at or near 1.0 may be used (1-norm). At mid-low frequencies, wherein acoustic coupling tends toward power summation, an exponent at or near 2.0 may be used (2-norm). Alternatively, or additionally, loudspeaker gains may be selected to optimize for uniform coverage at the lowest frequencies, and to optimize for spatial resolution at higher frequencies.

In some implementations, bass management bands may be dynamically enabled based on signal levels. For example, as the signal level increases the number of frequency bands used may also increase.

In some instances, a program may contain both audio objects and channels. According to some examples, different bass management methods may be used for program channels and audio objects. For example, traditional channel-based methods may be applied to the channels, whereas one or more of the audio object-based methods disclosed herein may be applied to the audio objects.

Some disclosed methods may treat at least some LF signals as audio objects that can be panned. As noted above, as the audio frequency increases, the loss of spatial information becomes increasingly apparent, and the artifacts caused by conventional bass management methods become more noticeable and unacceptable. Multi-band bass management methods can diminish such artifacts. Treating LF signals-particularly mid-LF signals-as objects that can be panned can also reduce such artifacts. Accordingly, it can be advantageous to combine multi-band bass management methods with methods that involve panning at least some LF signals. However, some implementations may involve panning at least some LF signals or multi-band bass management methods, but not both low-frequency object panning and multi-band bass management.

As noted above, traditional approaches to bass management, whereby filtering is applied to loudspeaker feeds, often fail to be optimal because panning laws often assume an acoustic power sum at the listener position. Conversely, bass managing multiple loudspeakers to the same subwoofer produces an electrical amplitude sum, leading to electrical bass build-up. Some disclosed methods circumvent this potential problem by panning low and high frequencies separately. Following high-pass rendering, a power 'audit' may determine the low frequency 'deficit' that is to be reproduced by subwoofers or other low-frequency-capable (LFC) loudspeakers.

Accordingly, some disclosed bass management methods may involve computing low-pass filter (LPF) coefficients and/or band-pass filter coefficients for mid-LF based on a low-frequency power deficit caused by bass management. Various examples are described in detail below. Bass management methods that involve computing low-pass filter coefficients and/or band-pass filter coefficients for mid-LF based on a low-frequency power deficit can reduce bass build-up. Such methods may or may not be implemented in combination with multi-band bass management methods and/or panning at least some LF signals, depending on the particular implementation. However, it can be advantageous to combine methods involving the computation of low-pass filter coefficients (and/or band-pass filter coefficients for mid-LF) based on a low-frequency power deficit with other bass management methods disclosed herein.

Figure 6:
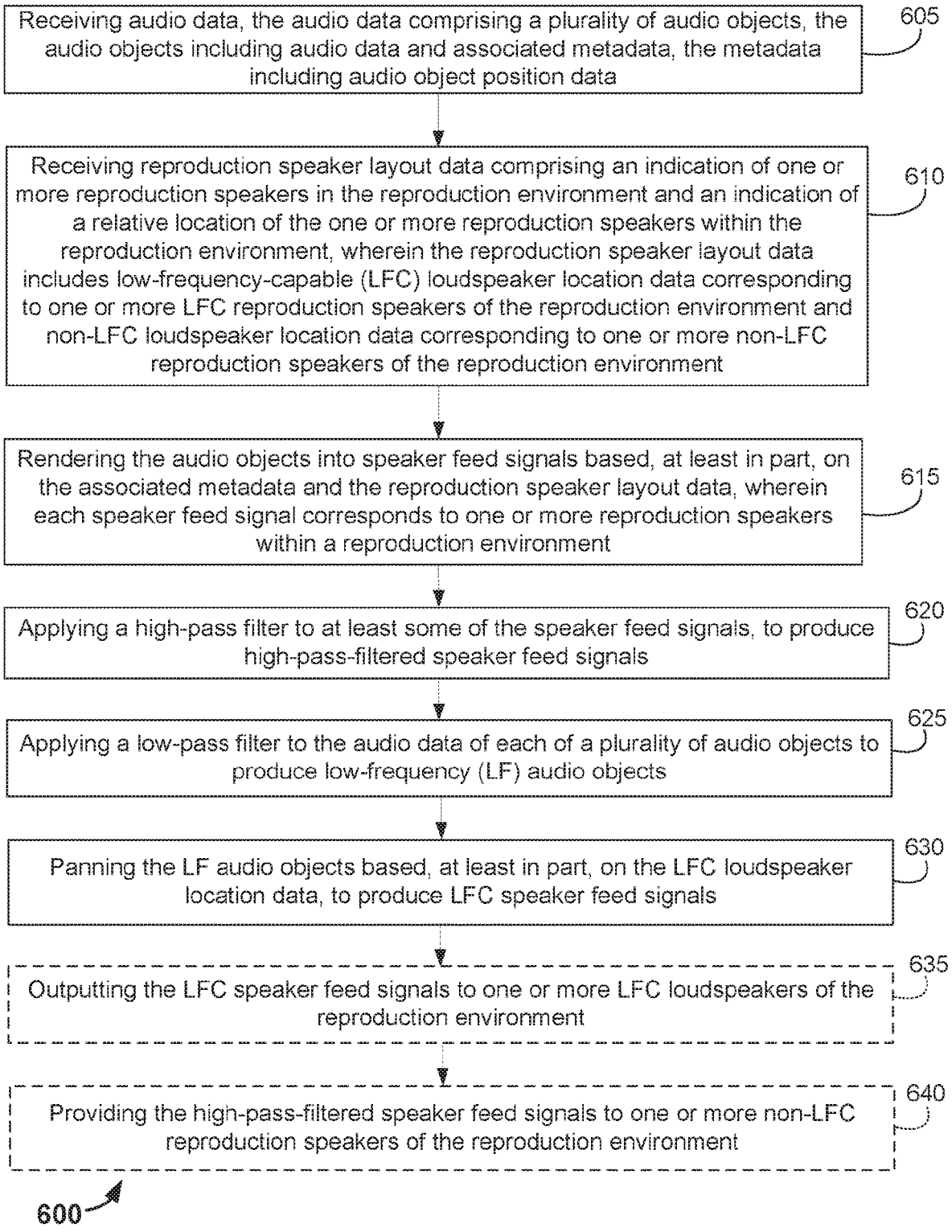
FIG. 6 is a flow diagram that shows blocks of a bass management method according to one example.

FIG. 6 is a flow diagram that shows blocks of a bass management method according to one example. The method 600 may, for example, be implemented by control system (such as the control system 15) that includes one or more processors and one or more non-transitory memory devices. As with other disclosed methods, not all blocks of method 600 are necessarily performed in the order shown in FIG. 6. Moreover, alternative methods may include more or fewer blocks.

In this example, method 600 involves panning LF audio signals that correspond to audio objects. Filtering, panning and other processes that operate on audio signals corresponding to audio objects may, for the sake of simplicity, be referred to herein as operating on the audio objects. For example, a process of applying a filter to audio data of an audio object may be described herein as applying a filter to the audio object. A process of panning audio data of an audio object may be described herein as panning the audio object.

According to this example, block 605 involves receiving audio data that includes a plurality of audio objects. The audio objects include audio data (which may be a monophonic audio signal) and associated metadata. In this example, the metadata include audio object position data.

Here, block 610 involves receiving reproduction speaker layout data that includes an indication of one or more reproduction speakers in the reproduction environment and an indication of a location of the one or more reproduction speakers within the reproduction environment. In some examples, the location may be relative to the location of one or more other location reproduction speakers within the reproduction environment, e.g., "center," "front left," "front right," "left surround," "right surround," etc. According to some examples, the reproduction speaker layout data may include an indication of one or more reproduction speakers in a reproduction environment like that shown in FIG. 1-3 or 4B, and an indication of a location (such as a relative location) of the one or more reproduction speakers within the reproduction environment. According to some implementations, the reproduction speaker layout data may include an indication of a location (which may be a relative location) of one or more groups of reproduction speakers within the reproduction environment. In this example, the reproduction speaker layout data includes low-frequency-capable (LFC) loudspeaker location data corresponding to one or more LFC reproduction speakers of the reproduction environment.

In some examples, the LFC reproduction speakers may include one or more types of subwoofers. Alternatively, or additionally, the reproduction environment may include the LFC reproduction speakers may include one or more types of wide-range and/or full-range loudspeakers that are capable of satisfactory reproduction of LF audio data. For example, some such LFC reproduction speakers may be capable of reproducing mid-LF audio data (e.g., audio data in the range of 80-150 Hz) without objectionable levels of distortion, while also being capable of reproducing audio data in a higher frequency range. In some instances, such full-range LFC reproduction speakers may be capable of reproducing most or all of the range of frequencies that is audible to human beings. Some such full-range LFC reproduction speakers may be suitable for reproducing audio data of 60 Hz or more, 70 Hz or more, 80 Hz or more, 90 Hz or more, 100 Hz or more, etc.

Accordingly, some LFC reproduction speakers of a reproduction environment may be dedicated subwoofers and some LFC reproduction speakers of a reproduction environment may be used both for reproducing LF audio data and non-LF audio data. The LFC reproduction speakers may, in some examples, include front speakers, center speakers, and/or surround speakers, such as wall surround speakers and/or rear surround speakers. For example, referring to FIG. 4B, some LFC reproduction speakers of a reproduction environment (such as the subwoofers shown in the front and in the rear of the reproduction environment 450) may be dedicated subwoofers and some LFC reproduction speakers of the reproduction environment (such as the surround speakers shown on the sides and in the rear of the reproduction environment 450) may be used for reproducing both LF audio data and non-LF audio data.

In this example, the reproduction speaker layout data also includes main loudspeaker location data corresponding to one or more main reproduction speakers of the reproduction environment. The main reproduction speakers may include relatively smaller speakers, as compared to the LFC reproduction speakers. The main reproduction speakers may be suitable for reproducing audio data of 100 Hz or more, 120 Hz or more, 150 Hz or more, 180 Hz or more, 200 Hz or more, etc., depending on the particular implementation. The main reproduction speakers may, in some examples, include ceiling speakers and/or wall speakers. Referring again to FIG. 4B, in some implementations most or all of the ceiling speakers and some of the side speakers may be main reproduction speakers.

Returning to FIG. 6, in this example block 615 involves rendering the audio objects into speaker feed signals based, at least in part, on the associated metadata and the reproduction speaker layout data. Here, each speaker feed signal corresponds to one or more reproduction speakers within a reproduction environment.

According to this example, block 620 involves applying a high-pass filter to at least some of the speaker feed signals, to produce high-pass-filtered speaker feed signals. In some instances, block 620 may involve applying a first high-pass filter to a first plurality of the speaker feed signals to produce first high-pass-filtered speaker feed signals and applying a second high-pass filter to a second plurality of the speaker feed signals to produce second high-pass-filtered speaker feed signals. The first high-pass filter may, for example, be configured to pass a lower range of frequencies than the second high-pass filter. According to some examples, block 620 may involve applying two or more different high-pass filters, to produce high-pass-filtered speaker feed signals having two or more different frequency ranges. Some examples are described below.

The high-pass filter(s) that are applied in block 620 may correspond with the capabilities of reproduction speakers in a reproduction environment. Some implementations of the method 600 may involve receiving involve reproduction speaker performance information regarding one or more types of main reproduction speakers in a reproduction environment.

Some such implementations may involve receiving first reproduction speaker performance information regarding a first set of main reproduction speakers and receiving second reproduction speaker performance information regarding a second set of main reproduction speakers. A first high-pass filter that is applied in block 620 may correspond to the first reproduction speaker performance information and a second high-pass filter that is applied in block 620 may correspond to the second reproduction speaker performance information. Such implementations may involve providing the first high-pass-filtered speaker feed signals to the first set of main reproduction speakers and providing the second high-pass-filtered speaker feed signals to the second set of main reproduction speakers.

In some examples, the high-pass filter(s) that are applied in block 620 may be based, at least in part, on metadata associated with an audio object. The metadata may, for example, include an indication of whether to apply a high-pass filter to the speaker feed signals corresponding to a particular audio object of the audio objects that are received in block 605.

In this example block 625 involves applying a low-pass filter to each of a plurality of audio objects, to produce low-frequency (LF) audio objects. As mentioned above, operations performed on the audio data of an audio object may be referred to herein as being performed on the audio object. Accordingly, in this example block 625 involves applying a low-pass filter to the audio data of each of a plurality of audio objects. In some examples, block 625 may involve applying two or more different filters. As described in more detail below, the filters applied in block 625 may include low-pass, bandpass and/or high-pass filters.

Some implementations may involve applying bass management methods only for audio signals that are at or above a threshold level. The threshold level may, in some instances, vary according to the capabilities of one or more types of main reproduction speakers of the reproduction environment. According to some such examples, method 600 may involve determining a signal level of the audio data of one or more audio objects. Such examples may involve comparing the signal level to a threshold signal level. Some such examples may involve applying the one or more low-pass filters only to audio objects for which the signal level of the audio data is greater than or equal to the threshold signal level.

In the example shown in FIG. 6, block 630 involves panning the LF audio objects based, at least in part, on the LFC loudspeaker location data, to produce LFC speaker feed signals. Here, optional block 635 involves outputting the LFC speaker feed signals to one or more LFC loudspeakers of the reproduction environment. Optional block 640 involves providing the high-pass-filtered speaker feed signals to one or more main reproduction speakers of the reproduction environment.

In some implementations, block 630 may involve producing more than one type of LFC speaker feed signals. For example, block 630 may involve producing LFC speaker feed signals that have different frequency ranges. The different frequency ranges may correspond to the capabilities of different LFC loudspeakers of the reproduction environment.

According to some such examples, block 625 may involve applying a low-pass filter to at least some of the audio objects, to produce first LF audio objects. The low-pass filter may be configured to pass a first range of frequencies. The first range of frequencies may vary according to the particular implementation. In some examples, the low-pass filter may be configured to pass frequencies below 60 Hz, frequencies below 80 Hz, frequencies below 100 Hz, frequencies below 120 Hz, frequencies below 150 Hz, etc.

In some such implementations, block 625 may involve applying a high-pass filter to the first LF audio objects to produce second LF audio objects. The high-pass filter may be configured to pass a second range of frequencies that is a mid-LF range of frequencies. For example, the high-pass filter may be configured to pass frequencies in a range from 80 to 150 Hz, a range from 60 to 150 Hz, a range from 60 to 120 Hz, a range from 80 to 120 Hz, a range from 100 to 150 Hz, a range from 60 to 150 Hz, etc.

In alternative implementations, block 625 may involve applying a bandpass filter to a second plurality of the audio objects to produce second LF audio objects. The bandpass filter may be configured to pass a second range of frequencies that is a mid-LF range of frequencies. For example, the bandpass filter may be configured to pass frequencies in a range from 80 to 150 Hz, a range from 60 to 150 Hz, a range from 60 to 120 Hz, a range from 80 to 120 Hz, a range from 100 to 150 Hz, a range from 60 to 150 Hz, etc.

According to some such implementations, block 630 may involve producing first LFC speaker feed signals by panning the first LF audio objects and producing second LFC speaker feed signals by panning the second LF audio objects. The first and second LFC speaker feed signals may be provided to different types of LFC loudspeakers of the reproduction environment. For example, referring again to FIG. 4B, some LFC reproduction speakers (such as the subwoofers shown in the front and in the rear of the reproduction environment 450) may be dedicated subwoofers and some LFC reproduction speakers (such as the surround speakers shown on the sides and in the rear of the reproduction environment 450) may be non-subwoofer loudspeakers that may be used for reproducing both LF audio data and non-LF audio data.

In some such examples, receiving the LFC loudspeaker location data in block 610 may involve receiving non-subwoofer location data indicating a relative location of each of a plurality of non-subwoofer reproduction speakers that are capable of reproducing audio data in the second range (the mid-LF range) of frequencies. According to some such implementations, block 630 may involve producing the second LFC speaker feed signals by panning at least some of the second LF audio objects based, at least in part, on the non-subwoofer location data to produce non-subwoofer speaker feed signals. Such implementations also may involve providing, in block 635, the non-subwoofer speaker feed signals to one or more of the plurality of non-subwoofer reproduction speakers of the reproduction environment.

Alternatively, or additionally, some of the dedicated subwoofers of the reproduction environment may be capable of reproducing audio signals in a lower range, as compared to other dedicated subwoofers of the reproduction environment. The latter may sometimes be referred to herein as "mid-subwoofers."

In some such examples, receiving the LFC loudspeaker location data in block 610 may involve receiving mid-subwoofer location data indicating a relative location of each of a plurality of mid-subwoofer reproduction speakers that are capable of reproducing audio data in the second range of frequencies. According to some such implementations, block 630 may involve producing the second LFC speaker feed signals by panning at least some of the second LF audio objects based, at least in part, on the mid-subwoofer location data to produce mid-subwoofer speaker feed signals. Such implementations also may involve providing, in block 635, the mid-subwoofer speaker feed signals to one or more of the plurality of mid-subwoofer reproduction speakers of the reproduction environment.

Figure 7:
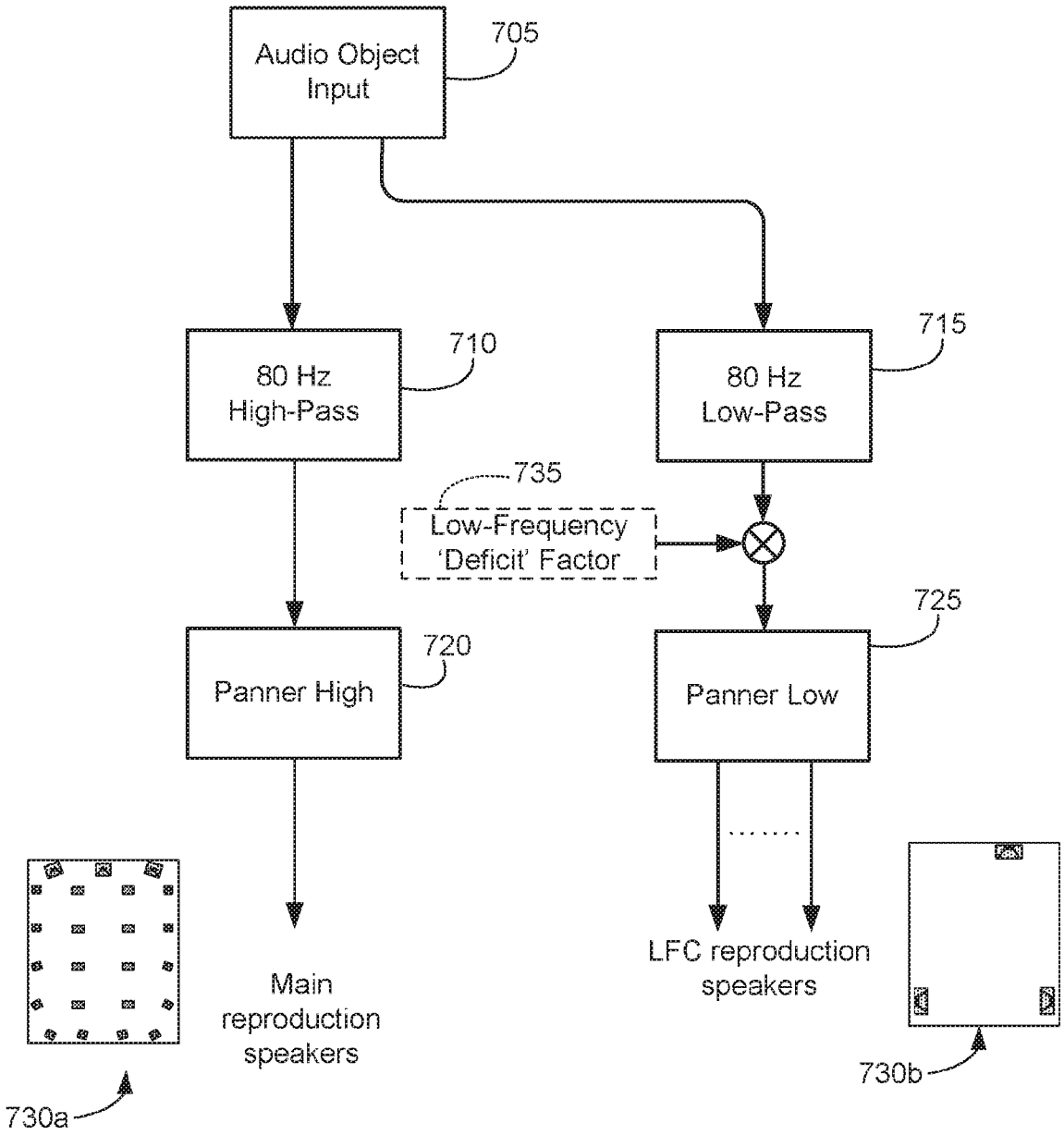
FIG. 7 shows blocks of a bass management method according to one disclosed example.

FIG. 7 shows blocks of a bass management method according to one disclosed example. According to this example, audio objects are received in block 705. Method 700 also involves receiving reproduction speaker layout data or retrieving the reproduction speaker layout data from a memory. In this example, the reproduction speaker layout data includes LFC loudspeaker location data corresponding to the LFC reproduction speakers of the reproduction environment. One example is shown in LFC reproduction speaker layout 730*b*, which indicates an LFC reproduction speaker in the front of a reproduction environment, another LFC reproduction speaker in the left rear of the reproduction environment and another LFC reproduction speaker in the right rear of the reproduction environment. However, alternative examples may include more LFC reproduction speakers, fewer LFC reproduction speakers and/or LFC reproduction speakers in different locations.

In this example, the reproduction speaker layout data includes main loudspeaker location data corresponding to main reproduction speakers of the reproduction environment. One example is shown in main reproduction speaker layout 730*a*, which indicates the locations of main reproduction speakers along the sides, in the ceiling and in the front of the reproduction environment. However, alternative examples may include more main reproduction speakers, fewer main reproduction speakers and/or main reproduction speakers in different locations. For example, some reproduction environments may not include main reproduction speakers in the front of the reproduction environment.

In this implementation, a crossover filter is implemented by applying the input audio signals corresponding to the received audio objects in parallel to a low-pass filter (block 715) and a high-pass filter (block 710). The crossover filter may, for example, be implemented by a control system such as the control system 15 of FIG. 5A. In this example, the crossover frequency is 80 Hz, but in alternative bass management methods may apply crossover filters having lower or higher frequencies. The crossover frequency may be selected according to system components (such as the capabilities of reproduction loudspeakers of a reproduction environment) and design goals.

According to this implementation, high-pass-filtered audio objects that are produced in block 710 are panned to speaker feed signals in block 720 based, at least in part, on metadata associated with the audio objects and the main loudspeaker location data. Each speaker feed signal may correspond to one or more main reproduction speakers within the reproduction environment.

In this example, LF audio objects that are produced in block 715 are panned to speaker feed signals in block 725 based, at least in part, on metadata associated with the audio objects and the LFC loudspeaker location data. Each speaker feed signal may correspond to one or more LFC reproduction speakers within the reproduction environment. In some examples, a bass-managed audio object may be expressed as described below with reference to Equation 13.

If more than one LFC reproduction speaker is available, the bass-managed audio object can be panned according to the LFC reproduction speaker geometry using, for example, dual-balance amplitude panning.

In the example shown in FIG. 7, optional block 735 involves applying a low-frequency deficit factor to the LF audio objects that are produced in block 715, prior to the time that the LF audio objects are panned to speaker feed signals in block 725. The low-frequency deficit factor may be applied to compensate, at least in part, for the "power deficit" caused by applying the high-pass filter in block 710. After high-pass filtering and/or rendering, a power "audit" may determine a low-frequency deficit factor that is to be reproduced by the LFC reproduction speakers. The low-frequency deficit factor may be based on the power of the high-pass-filtered speaker feed signals and the shape of the high-pass filter that is applied in block 710.

However, in some alternative examples, one or more of the filters that are used to produce the LF audio objects may be based, at least in part, on the power deficit. For example, referring to FIG. 6, one or more of the filters that are applied in block 625 may be based, at least in part, on the power deficit. In some such examples, method 600 may involve calculating the power deficit based, at least in part, on the high-pass-filtered speaker feed signals that are produced in block 620. According to some such examples, characteristics of one or more low-pass filters that are applied in block 625 may be determined based, at least in part, on the power deficit. The power deficit may be based, at least in part, on the power of the high-pass-filtered speaker feed signals and on a shape of the high-pass filter(s) that are applied in block 620.

Let $g_m$ be an object's panning gain for loudspeaker $m \in \{1 \ldots M\}$, where M is the total number of full-range loudspeakers. In this example, the panned audio object is first high-passed at cutoff frequency $\omega_m$ with a filter having a transfer function $F_H(\omega;\ \omega_m)$. In the example case of a Butterworth filter, the magnitude response of the transfer function may be expressed as:

$$F_H(\omega;\ \omega_m) = \sqrt{\frac{1}{1 + \left(\frac{\omega_m}{\omega}\right)^{2n}}} \qquad \text{(Equation 2)}$$

In Equation 2, n represents the number of poles in the filter. In some examples, n may be 4. However, n may be more or less than 4 in alternative implementations. Assuming power summation throughout the entire frequency range, the power $p(\omega)$ received from the bass-managed full-range loudspeakers at the listener position may be expressed as follows:

$$p(\omega) = \sum_{m=1}^{M} g_m^2 F_H^2(\omega;\ \omega_m). \qquad \text{Equation 3}$$

The power deficit may therefore be expressed as follows:

$$d(\omega) = 1 - p(\omega) \qquad \text{Equation 4}$$

The spectrum reproduced by an ideal LFC reproduction speaker may therefore be expressed as follows:

$$c(\omega) = \sqrt{d(\omega)}\,. \qquad \text{Equation 5}$$

In Equation 5, c represents the ideal subwoofer spectrum. According to this implementation, low-frequency filtering is applied using Butterworth filters of the same form as those of the high-pass path. Unfortunately, the ideal LFC reproduction speaker spectrum cannot be exactly matched by a linear combination (weighted sum) of low-pass Butterworth filters. This statement is better understood when the matching problem is written explicitly:

$$\sqrt{1 - \sum_{m=1}^{M} g_m^2 F_H^2(\omega;\ \omega_m)} \simeq \sum_{m=1}^{M} h_m F_L(\omega;\ \omega_m) \qquad \text{Equation 6}$$

In Equation 6, $h_m$ represents weights to be calculated and applied. Where a Butterworth filter with low-pass transfer function magnitude $F_L(\omega;\ \omega_m)$ is used to produce a low frequency feed, the low-pass transfer function magnitude may be expressed as follows:

$$F_L(\omega;\omega_m)=\sqrt{\frac{1}{1+\left(\frac{\omega}{\omega_m}\right)^{2n}}}, \quad \text{Equation 7}$$

An optimal, approximate solution can be derived by sampling the spectra ω at discrete frequencies $\omega_k$, $k\in\{1 \ldots K\}$ and finding a constrained least-squares solution for the weights $h_m$. From the variables defined above, we can derive the following vectors and matrices:

$$F_m=[F_L(\omega_1;\omega_m)\ F_L(\omega_2;\omega_m)\ \ldots\ F_L(\omega_K;\omega_m)]^T\in\mathbb{R}^{K\times 1} \quad \text{Equation 8}$$

$$F=[F_1\ \ldots\ F_M] \quad \text{Equation 9}$$

$$c=[c(\omega_1)\ c(\omega_2)\ \ldots\ c(\omega_K)]^T \quad \text{Equation 10}$$

$$h=[h_1\ \ldots\ h_M]^T, \quad \text{Equation 11}$$

so that Fh=c. In Equation 10, c represents a vector form of the subwoofer spectrum and $c(\omega_1)\ c(\omega_2)\ \ldots\ c(\omega_K)$ represent the subwoofer spectrum evaluated at a set of discrete frequencies. The choice of total frequencies K is arbitrary. However, it has been found empirically that sampling at frequencies $\omega_m$, $\omega_m/2$ and $\omega_m/4$ produces acceptable results. Constraining the weights to be nonnegative, the optimization problem can be stated as follows:

$$\hat{h}=\arg\min_h \|Fh-c\|_2^2 \text{ subject to } h_m>0 \quad \text{Equation 12}$$

Let $h_{ij}$ be the optimal weights for object $i\in\{1 \ldots N\}$ and unique cutoff frequency index $j=\{1 \ldots J\}$. In some implementations, the bass-managed audio object may be expressed as follows:

$$y_{BM}^i(t)=\sum_{j=1}^{J} h_{i,j}x_i(t)*f_j(t), \quad \text{Equation 13}$$

In Equation 13, * represents linear convolution and $f_j(t)$ represents the impulse response of the low-pass filter at cutoff frequency index j.

A final issue arises with the phase responses of the Butterworth filters, which are 180° at the cutoff frequency for a 4th order filter. Summation of filters where a transition band overlaps a passband causes a dip when the two filter responses are out of phase. By delaying filters with high cutoff frequency so that their DC group delay matches the group delay of the filter with lowest cutoff frequency, the point at which the filters are 180° out of phase may be pushed into the stop band, where it has less effect.

Figure 8:
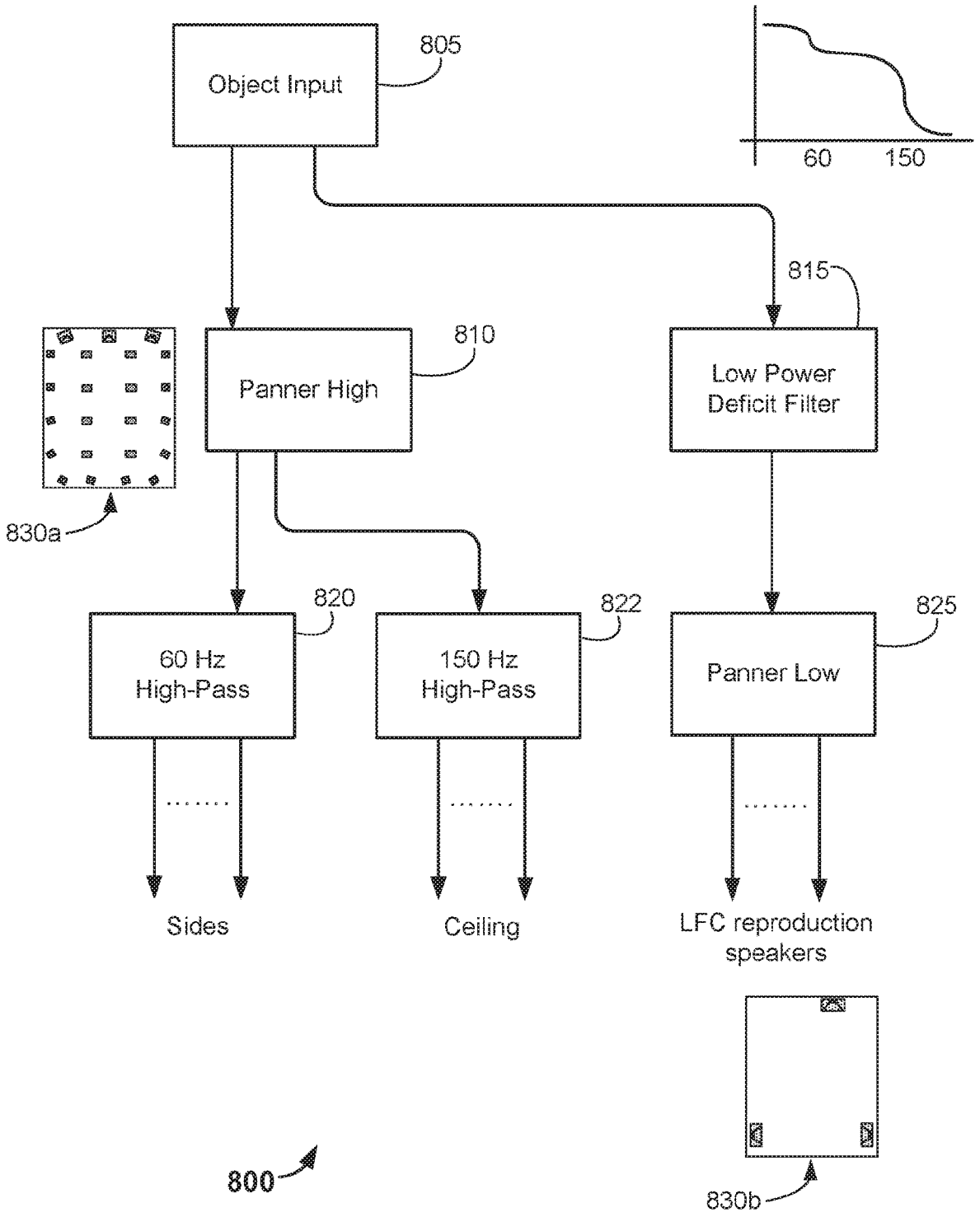
FIG. 8 shows blocks of an alternative bass management method according to one disclosed example.

FIG. 8 shows blocks of an alternative bass management method according to one disclosed example. According to this example, audio objects are received in block 805. Method 800 also involves receiving reproduction speaker layout data (or retrieving the reproduction speaker layout data from a memory), including main loudspeaker location data corresponding to main reproduction speakers of the reproduction environment. One example is shown in main reproduction speaker layout 830*a*, which indicates the locations of main reproduction speakers along the sides, in the ceiling and in the front of the reproduction environment. However, alternative examples may include more main reproduction speakers, fewer main reproduction speakers and/or main reproduction speakers in different locations. For example, some reproduction environments may not include main reproduction speakers in the front of the reproduction environment.

In this example, the reproduction speaker layout data also includes LFC loudspeaker location data corresponding to the LFC reproduction speakers of the reproduction environment. One example is shown in LFC reproduction speaker layout 830*b*. However, alternative examples may include more LFC reproduction speakers, fewer LFC reproduction speakers and/or LFC reproduction speakers in different locations.

According to this implementation, at least some audio objects are panned to speaker feed signals before high-pass filtering. Here, bass-managed audio objects are panned to speaker feed signals in block 810 before any high-pass-filters are applied. The panning process of block 810 may be based, at least in part, on metadata associated with the audio objects and the main loudspeaker location data. Each speaker feed signal may correspond to one or more main reproduction speakers within the reproduction environment.

In this implementation, a first high-pass filter is applied in block 820 and a second high-pass filter is applied in block 822. Other implementations may involve applying three or more different high-pass filters. According to this example, the first high-pass filter is a 60 Hz high-pass filter and the second high-pass filter is a 150 Hz high-pass filter. In this example, the first high-pass filter corresponds to capabilities of reproduction speakers on the sides of the reproduction environment and the second high-pass filter corresponds to capabilities of reproduction speakers on the ceiling of the reproduction environment. The first high-pass filter and the second high-pass filter may, for example, be determined by a control system based, at least in part, on stored or received reproduction speaker performance information.

In the example shown in FIG. 8, the one or more filters that used to produce LF audio objects in block 815 are based, at least in part, on a power deficit. In some such examples, method 800 may involve calculating the power deficit based, at least in part, on the high-pass-filtered speaker feed signals that are produced in blocks 820 and 822. The power deficit may be based, at least in part, on the power of the high-pass-filtered speaker feed signals and on the shape of the high-pass filters that are applied in blocks 820 and 822.

In this example, LF audio objects that are produced in block 815 are panned to speaker feed signals in block 825 based, at least in part, on metadata associated with the audio objects and the LFC loudspeaker location data. Each speaker feed signal may correspond to one or more LFC reproduction speakers within the reproduction environment.

Figure 9:
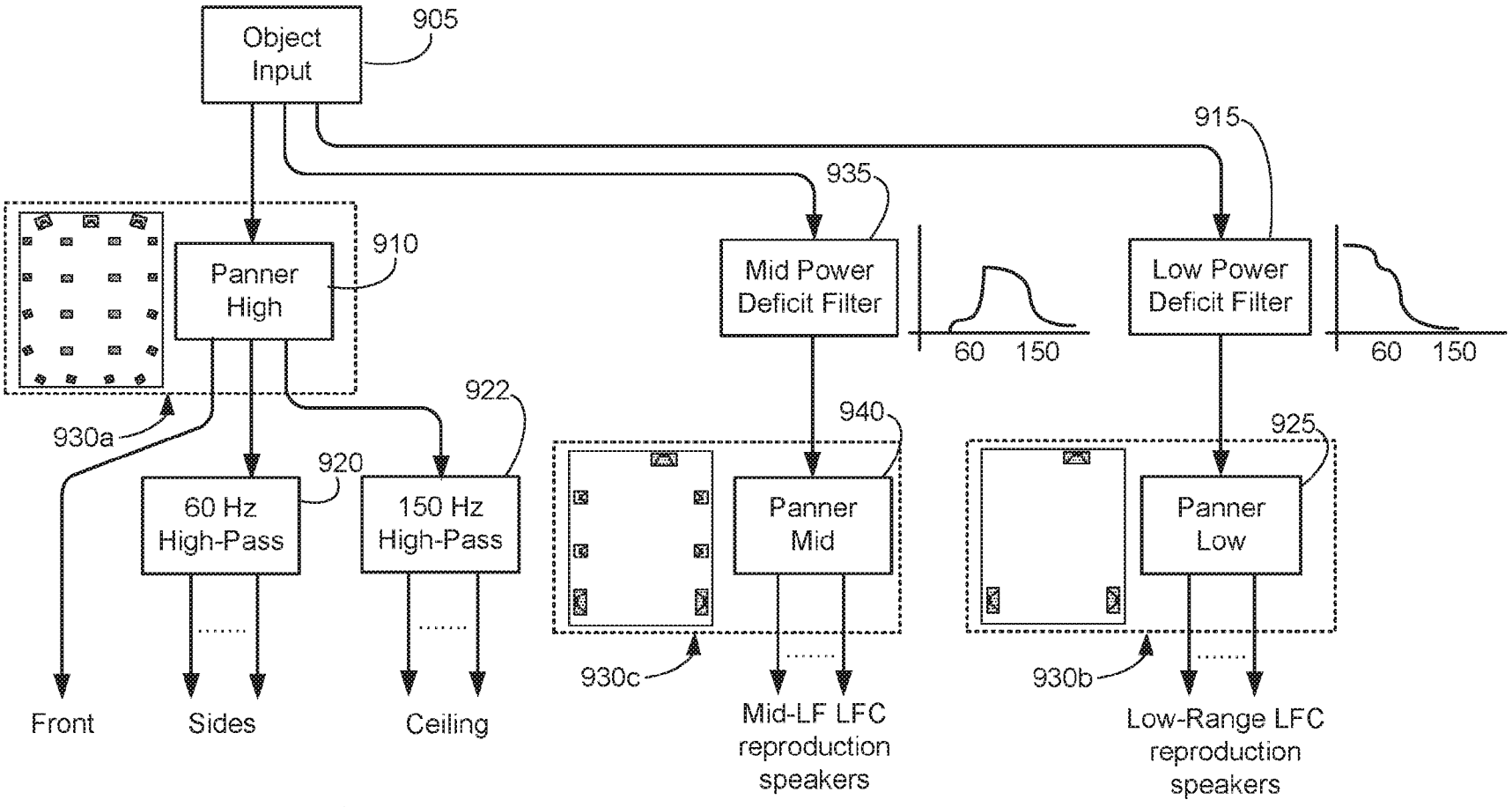
FIG. 9 shows blocks of another bass management method according to one disclosed example.

FIG. 9 shows blocks of another bass management method according to one disclosed example. According to this example, audio objects are received in block 905. Method 900 also involves receiving reproduction speaker layout data (or retrieving the reproduction speaker layout data from a memory), including main loudspeaker location data corresponding to main reproduction speakers of the reproduction environment. One example is shown in main reproduction speaker layout 930*a*, which indicates the locations of main reproduction speakers along the sides, in the ceiling and in the front of the reproduction environment. However, alternative examples may include more main reproduction speakers, fewer main reproduction speakers and/or main reproduction speakers in different locations. For example, some reproduction environments may not include main reproduction speakers in the front of the reproduction environment.

In this example, the reproduction speaker layout data also includes LFC loudspeaker location data corresponding to the LFC reproduction speakers of the reproduction environment. Examples are shown in LFC reproduction speaker layouts 930*b* and 930*c*. However, alternative examples may include more LFC reproduction speakers, fewer LFC reproduction speakers and/or LFC reproduction speakers in different locations. In these examples, the dark circles within the reproduction speaker layout 930*b* indicate the locations of LFC reproduction speakers that are capable of reproducing audio data in a range of approximately 60 Hz or less, whereas the dark circles within the reproduction speaker layout 930*c* indicate the locations of LFC reproduction speakers that are capable of reproducing audio data in a range of approximately 60 Hz to 150 Hz. According to this example, reproduction speaker layout 930*b* indicates the locations of dedicated subwoofers, whereas reproduction speaker layout 930*c* indicates the locations of wide-range and/or full-range loudspeakers that are capable of satisfactory reproduction of LF audio data. For example, the LFC reproduction speakers shown in reproduction speaker layout 930*c* may be capable of reproducing mid-LF audio data (e.g., audio data in the range of 80-150 Hz) without objectionable levels of distortion, while also being capable of reproducing audio data in a higher frequency range. In some instances, the LFC reproduction speakers shown in reproduction speaker layout 930*c* may be capable of reproducing most or all of the range of frequencies that is audible to human beings.

According to this implementation, bass-managed audio objects are panned to speaker feed signals in block 910 before any high-pass-filters are applied. The panning process of block 910 may be based, at least in part, on metadata associated with the audio objects and the main loudspeaker location data. Each speaker feed signal may correspond to one or more main reproduction speakers within the reproduction environment.

In this implementation, a first high-pass filter is applied in block 920 and a second high-pass filter is applied in block 922. Other implementations may involve applying three or more different high-pass filters. According to this example, the first high-pass filter is a 60 Hz high-pass filter and the second high-pass filter is a 150 Hz high-pass filter. In this example, the first high-pass filter corresponds to capabilities of reproduction speakers on the sides of the reproduction environment and the second high-pass filter corresponds to capabilities of reproduction speakers on the ceiling of the reproduction environment. The first high-pass filter and the second high-pass filter may, for example, be determined by a control system based, at least in part, on stored or received reproduction speaker performance information.

In the example shown in FIG. 9, the one or more filters that used to produce LF audio objects in blocks 915 and 935 are based, at least in part, on a power deficit. In some such examples, method 900 may involve calculating the power deficit based, at least in part, on the high-pass-filtered speaker feed signals that are produced in blocks 920 and 922. The power deficit may be based, at least in part, on the power of the high-pass-filtered speaker feed signals and on the shape of the high-pass filters that are applied in blocks 920 and 922.

In this example, LF audio objects that are produced in block 915 are panned to speaker feed signals in block 925 based, at least in part, on metadata associated with the audio objects and on LFC loudspeaker location data that corresponds with reproduction speaker layout 930*b*. According to this example, mid-LF audio objects that are produced in block 935 are panned to speaker feed signals in block 940 based, at least in part, on metadata associated with the audio objects and on LFC loudspeaker location data that corresponds with reproduction speaker layout 930*c*.

Figure 10:
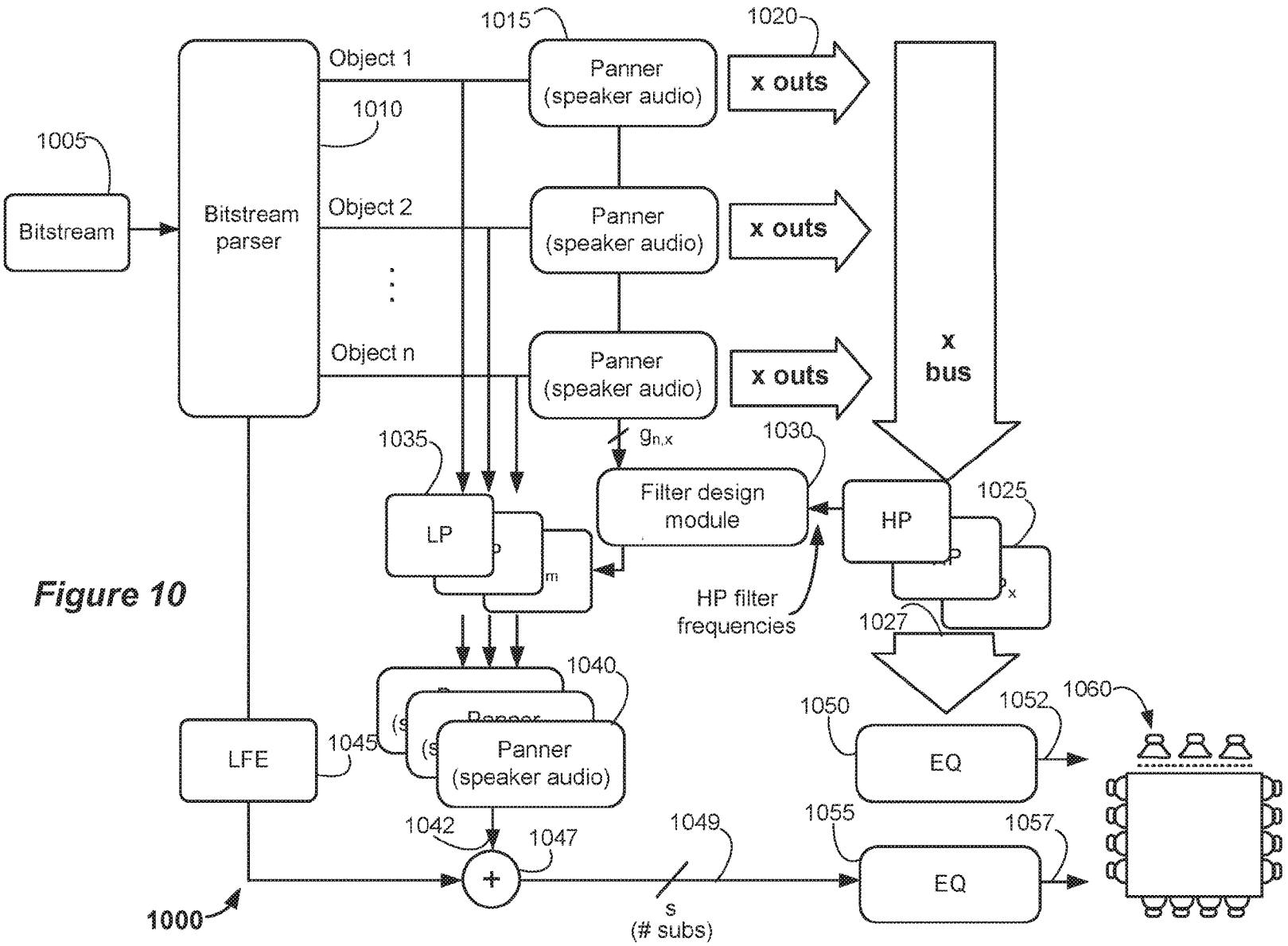
FIG. 10 is a functional block diagram that illustrates another disclosed bass management method.

FIG. 10 is a functional block diagram that illustrates another disclosed bass management method. At least some of the blocks shown in FIG. 10 may, in some examples, be implemented by a control system such as the control system 15 that is shown in FIG. 5A. In this example, a bitstream 1005 of audio data, which includes audio objects and low-frequency effect (LFE) audio signals 1045, is received by a bitstream parser 1010. According to this example, the bitstream parser 1010 is configured to provide the received audio objects to the panners 1015 and to the low-pass filters 1035. In this example, the bitstream parser 1010 is configured to provide the LFE audio signals 1045 to the summation block 1047.

According to this example, the speaker feed signals 1020 output by the panners 1015 are provided to a plurality of high-pass filters 1025. Each of the high-pass filters 1025 may, in some implementations, correspond with the capabilities of main reproduction speakers of the reproduction environment 1060.

According to this example, the filter design module 1030 is configured to determine the characteristics of the filters 1035 based, at least in part, on a calculated power deficit that results from bass management. In this example, the filter design module 1030 is configured to determine the characteristics of the low-pass filters 1035 based, at least in part, on gain information received from the panners 1015 and on high-pass filter characteristics, including high-pass filter frequencies, received from the high-pass filters 1025. In some implementations, the filters 1035 may also include bandpass filters, such as bandpass filters that are configured to pass mid-LF audio signals. In some examples, the filters 1035 may also include high-pass filters, such as high-pass filters that are configured to operate on low-pass-filtered audio signals to produce mid-LF audio signals. According to some such implementations, the filter design module 1030 may be configured to determine the characteristics of the bandpass filters and/or high-pass filters based, at least in part, on a calculated power deficit that results from bass management.

According to this example, LF audio objects output from the filters 1035 are provided to the panners 1040, which output LF speaker feed signals 1042. In this implementation, the summation block 1047 sums the LF speaker feed signals 1042 and the LFE audio signals 1045, and provides the result (the LF signals 1049) to the equalization block 1055. In this example, the equalization block 1055 is configured to equalize the LF signals 1049 and also may be configured to apply one or more types of gains, delays, etc. In this implementation, the equalization block 1055 is configured to output the resulting LF speaker feed signals 1057 to LFC reproduction speakers of the reproduction environment 1060.

According to this example, high-pass-filtered audio signals 1027 from the high-pass filters 1025 are provided to the equalization block 1050. In this example, the equalization block 1050 is configured to equalize the high-pass-filtered audio signals 1027 and also may be configured to apply one or more types of gains, delays, etc. Here, the equalization block 1050 outputs the resulting high-pass-filtered speaker feed signals 1052 to main reproduction speakers of the reproduction environment 1060.

Some alternative implementations may not involve panning LF audio objects. Some such alternative implementations may involve panning bass uniformly to all subwoofers. Such implementations allow audio object summation to take place prior to filtering, thereby saving computational complexity. In some such examples, the bass-managed signal may be expressed as:

$$y_{BM}(t) = \sum_{j=1}^{J} \left[ \sum_{i=1}^{N} h_{i,j} x_i(t) \right] * f_j(t) \qquad \text{Equation 14}$$

In Equation 14, N represents the number of audio objects and J represents the number of cutoff frequencies. In some implementations, the resulting $y_{BM}(t)$ may be fed equally to all LFC reproduction speakers, or to all subwoofers, at a level that preserves the perceived bass amplitude at the listening position.

Figure 11:
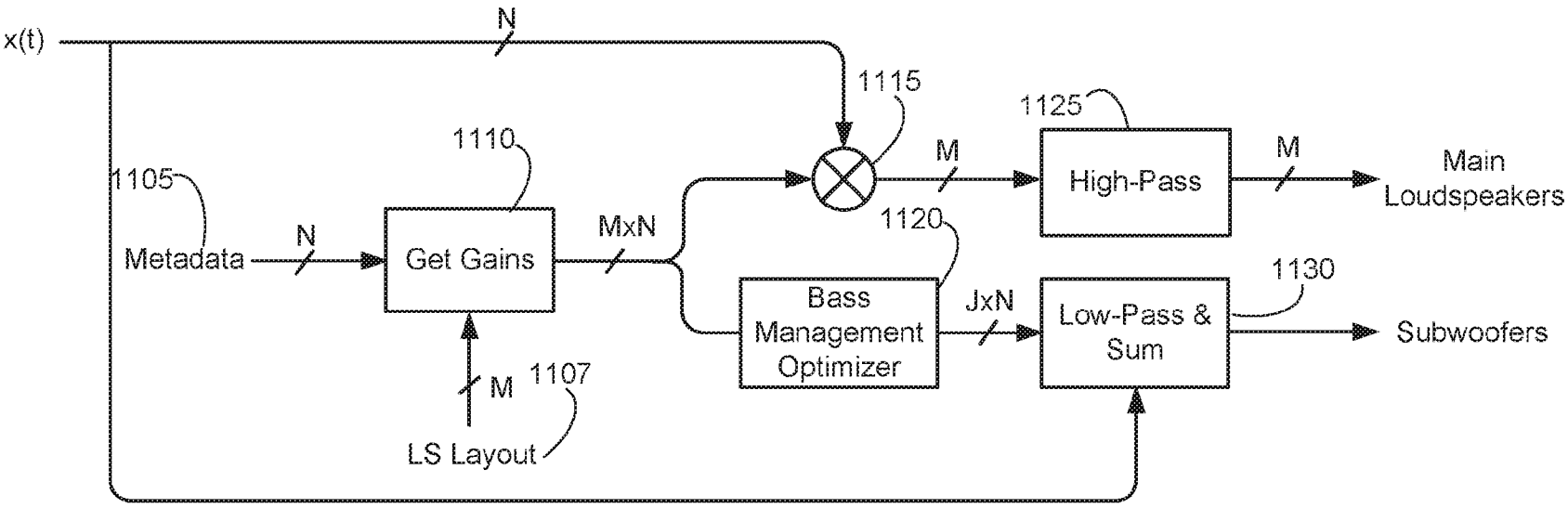
FIG. 11 is a functional block diagram that shows one example of a uniform bass implementation.

FIG. 11 is a functional block diagram that shows one example of a uniform bass implementation. Block 1115 represents panner that targets the main loudspeakers (panner high in previous examples), and is followed by a high-pass filter uniquely applied to each main loudspeaker signal. Block 1130 replaces the functional blocks of low frequency panning and filtering of the previous examples. Replacing panned bass processing with a simple summation for each unique crossover frequency reduces calculations required; in addition to removing the need to compute low frequency signal panning, the equations can be rearranged such that only J low-pass filters need be run in real time. For panned bass, JN filters are required, which may be unacceptable for a real-time implementation. This example is most appropriate for systems with relatively low crossover frequency and less need for LF spatial accuracy.

As the crossover frequency increases beyond around 150 Hz, a significant shift in the apparent acoustic image can occur when a loudspeaker is bass managed to distant subwoofers. The problem lends itself nicely to decimation, because the LFC reproduction speaker frequencies are generally very low compared with the sampling frequency. The aim is to reduce the computational cost of filtering operations to allow each audio object to be processed independently without a significant CPU load.

Figure 12:
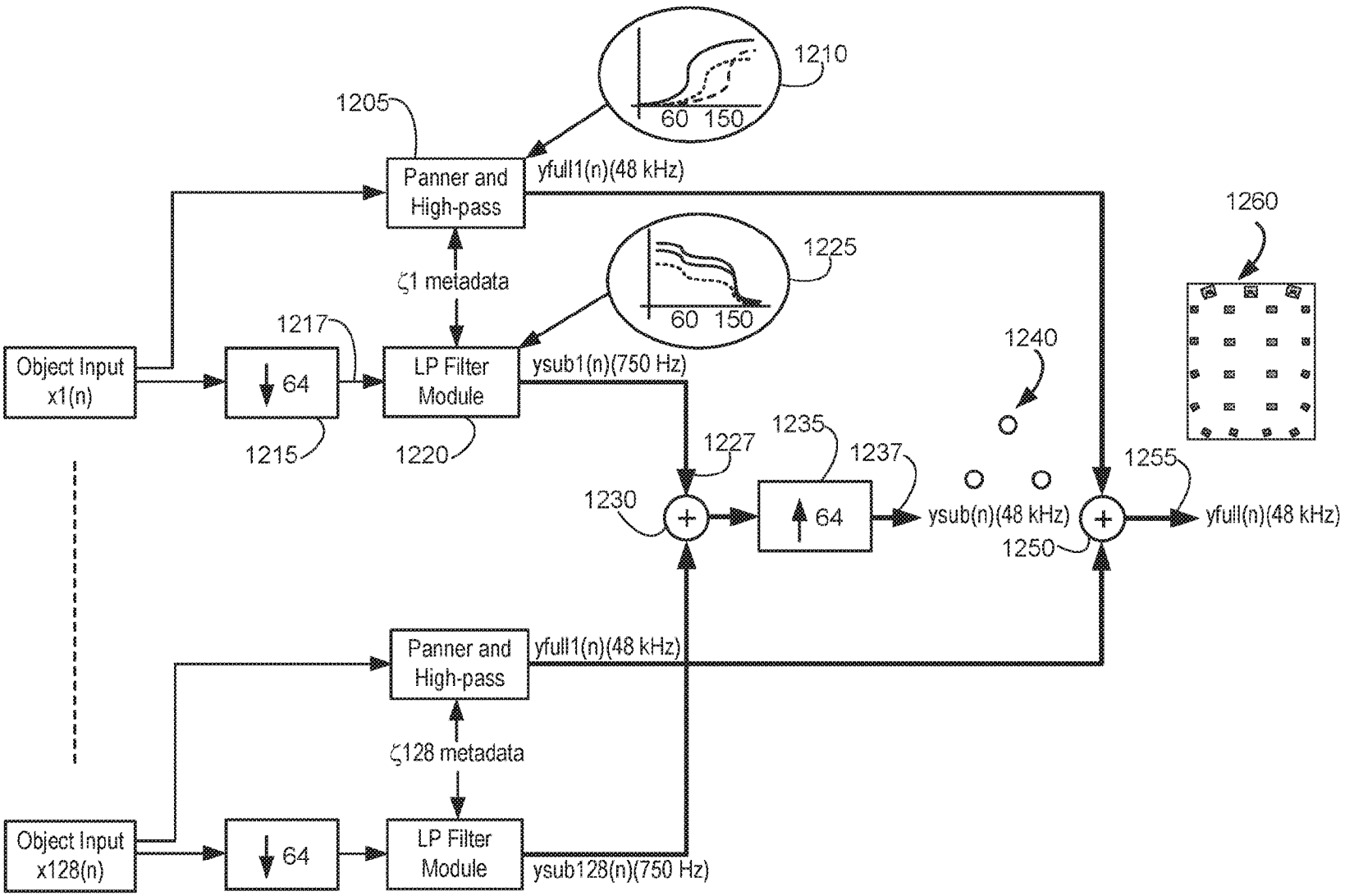
FIG. 12 is a functional block diagram that provides an example of decimation according to one disclosed bass management method.

FIG. 12 is a functional block diagram that provides an example of decimation according to one disclosed bass management method. According to this example, the panner and high-pass blocks 1205 first apply an amplitude panner according to the audio object position data and main loudspeaker layout data, then apply a high-pass filter for each of the active channels as shown in the graph 1210. In some examples, the high-pass filters may be Butterworth filters. This is equivalent to the high-pass path that is described above with reference to Equations 7 and 8.

According to this example, the decimation blocks 1215 are configured to decimate the audio signals of input audio objects. In this example, the decimation blocks 1215 are 64× decimation blocks. In some such examples, the decimation blocks 1215 may be 6-stage ½ decimator using pre-calculated halfband filters. In some examples, the halfband filters may have a stopband rejection of 80 dB. In other examples, the decimation blocks 1215 may decimate the audio data to a different extent and/or may use different types of filters and related processes.

Halfband filters have the following properties:

1. Approximately half the coefficients are zero.
2. Non-zero coefficients are symmetrical (linear phase, halved multiplies).
3. The transition band is symmetrical about ¼ the sampling frequency, which produces aliasing towards the top of the band after each decimation stage. For this reason, some implementations use a longer final filter in order to remove any residual aliasing.

With respect to property 3, in the case of subwoofer feeds it may be acceptable to allow aliasing to reside above about 300 Hz. For example, if one defines a maximum cutoff frequency of 150 Hz, the subwoofer feed is at least −24 dB by 300 Hz so it is reasonable to assume that aliasing at these frequencies would be masked by the full range loudspeaker feeds.

With a sampling frequency of 48 kHz, the effective sampling frequency at the final stage is 750 Hz, leading to a Nyquist frequency of 375 Hz. Accordingly, in some implementations one may define 300 Hz as the minimum frequency for which aliasing components can be tolerated.

According to this example, the LP filter modules 1220 are configured to design and apply filters for producing LF audio data. As described elsewhere herein, the filters applied for producing LF audio data also may include bandpass and high-pass filters in some implementations. In this implementation, the LP filter modules 1220 are configured to design the filters based, at least in part, on decimated audio data received from the decimation blocks 1215, as well as on a bass power deficit (as depicted in the graphs 1225). The LP filter modules 1220 may be configured to determine the power deficit according to one or more of the methods described above.

For example, combining the analytic magnitude spectrum of a Butterworth high-pass filter with the deficit equation above (Equation 5), the spectrum of the LFC reproduction speaker feed may be expressed as follows:

$$c(\omega) = \sqrt{1 - \sum_{m=1}^{M} \frac{g_m^2}{1 + \left(\frac{\omega_m}{\omega}\right)^{2n}}} \qquad \text{Equation 15}$$

The filter c(w) can be designed, for example, as a finite impulse response (FIR) filter and applied at a 64× decimated rate.

In this example, the LP filter modules 1220 are also configured to pan the LF audio data produced by the designed filters. According to this example, LF speaker feed signals produced by the LP filter modules 1220 are provided to the summation block 1230. The summed LF speaker feed signals produced by the summation block 1230 are provided to the interpolation block 1235, which is configured to output LF speaker feed signals at the original input sample rate. The resulting LF speaker feed signals 1237 may be provided to LFC reproduction speakers 1240 of a reproduction environment.

In this example, high-pass speaker feed signals produced by the panner and high-pass blocks 1205 are provided to the summation block 1250. The summed high-pass speaker feed signals 1255 produced by the summation block 1250 are provided to main reproduction speakers 1260 of the reproduction environment.

Various modifications to the implementations described in this disclosure may be readily apparent to those having ordinary skill in the art. The general principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

The invention claimed is:

1. An audio processing method, comprising:

receiving audio data, the audio data comprising a plurality of audio objects, the audio objects including audio data and associated metadata, the metadata including audio object position data;

receiving reproduction speaker layout data comprising an indication of one or more reproduction speakers in a reproduction environment and an indication of a location of the one or more reproduction speakers within the reproduction environment, wherein the reproduction speaker layout data includes low-frequency-capable (LFC) speaker location data corresponding to one or more LFC reproduction speakers of the reproduction environment and main speaker location data corresponding to one or more main reproduction speakers of the reproduction environment;

rendering the audio objects into speaker feed signals based, at least in part, on the associated metadata and the reproduction speaker layout data, wherein each speaker feed signal corresponds to the one or more reproduction speakers within the reproduction environment;

applying a high-pass filter to at least some of the speaker feed signals, to produce high-pass-filtered speaker feed signals;

applying a low-pass filter to the audio data of each of the plurality of audio objects to produce low-frequency (LF) audio objects;

panning the LF audio objects based, at least in part, on the LFC speaker location data, to produce LFC speaker feed signals;

outputting the LFC speaker feed signals to the one or more LFC reproduction speakers of the reproduction environment; and providing the high-pass-filtered speaker feed signals to the one or more main reproduction speakers of the reproduction environment, wherein producing the LF audio objects comprises applying two or more different filters.

2. The method of claim 1, further comprising decimating the audio data of one or more of the audio objects before or as part of an application of the low-pass filter to the audio data of each of the plurality of the audio objects.

3. The method of claim 1, further comprising determining a signal level of the audio data of the audio objects, comparing the signal level to a threshold signal level and applying the low-pass filter only to audio objects for which the signal level of the audio data is greater than or equal to the threshold signal level.

4. The method of claim 1, further comprising:

calculating a power deficit based, at least in part, on a gain and high-pass filter(s) characteristics;

determining the low-pass filter based, at least in part, on the power deficit.

5. The method of claim 1, wherein applying the high-pass filter to at least some of the speaker feed signals comprises applying two or more different high-pass filters.

6. The method of claim 1, wherein applying the high-pass filter to at least some of the speaker feed signals comprises applying a first high-pass filter to a first plurality of the speaker feed signals to produce first high-pass-filtered speaker feed signals and applying a second high-pass filter to a second plurality of the speaker feed signals to produce second high-pass-filtered speaker feed signals, the first high-pass filter configured to pass a lower range of frequencies than the second high-pass filter.

7. The method of claim 6, further comprising receiving first reproduction speaker performance information regarding a first set of main reproduction speakers and receiving second reproduction speaker performance information regarding a second set of main reproduction speakers, wherein:

the first high-pass filter corresponds to the first reproduction speaker performance information;

the second high-pass filter corresponds to the second reproduction speaker performance information; and providing the high-pass-filtered speaker feed signals to the one or more main reproduction speakers comprises providing the first high-pass-filtered speaker feed signals to the first set of main reproduction speakers and providing the second high-pass-filtered speaker feed signals to the second set of main reproduction speakers.

8. The method of claim 1, wherein the metadata includes an indication of whether to apply the high-pass filter to speaker feed signals corresponding to a particular audio object of the audio objects.

9. The method of claim 1, wherein producing the LF audio objects comprises:

applying the low-pass filter to at least some of the audio objects, to produce first LF audio objects, the low-pass filter being configured to pass a first range of frequencies; and applying the high-pass filter to the first LF audio objects to produce second LF audio objects, the high-pass filter being configured to pass a second range of frequencies that is a mid-LF range of frequencies; and wherein panning the LF audio objects based, at least in part, on the LFC speaker location data, to produce the LFC speaker feed signals comprises:

producing first LFC speaker feed signals by panning the first LF audio objects; and producing second LFC speaker feed signals by panning the second LF audio objects.

10. The method of claim 9, wherein receiving the LFC speaker location data comprises receiving non-subwoofer location data indicating a location of each of a plurality of non-subwoofer reproduction speakers capable of reproducing audio data in the second range of frequencies, wherein producing the second LFC speaker feed signals comprises panning at least some of the second LF audio objects based, at least in part, on the non-subwoofer location data to produce non-subwoofer speaker feed signals, further comprising providing the non-subwoofer speaker feed signals to one or more of the plurality of non-subwoofer reproduction speakers of the reproduction environment.

11. The method of claim 9, wherein receiving the LFC speaker location data comprises receiving mid-subwoofer location data indicating a location of each of a plurality of mid-subwoofer reproduction speakers capable of reproducing audio data in the second range of frequencies, wherein producing the second LFC speaker feed signals comprises panning at least some of the second LF audio objects based, at least in part, on the mid-subwoofer location data to produce mid-subwoofer speaker feed signals, further comprising providing the mid-subwoofer speaker feed signals to one or more of the plurality of mid-subwoofer reproduction speakers of the reproduction environment.

12. The method of claim 1, wherein producing the LF audio objects comprises:

applying the low-pass filter to a first plurality of the audio objects, to produce first LF audio objects, the low-pass filter being configured to pass a first range of frequencies; and applying a bandpass filter to a second plurality of the audio objects to produce second LF audio objects, the bandpass filter being configured to pass a second range of frequencies that is a mid-LF range of frequencies; and wherein panning the LF audio objects based, at least in part, on the LFC speaker location data, to produce the LFC speaker feed signals comprises:

producing first LFC speaker feed signals by panning the first LF audio objects; and producing second LFC speaker feed signals by panning the second LF audio obj ects.

13. The method of claim 1, wherein the reproduction speaker layout data includes an indication of a location of one or more groups of reproduction speakers within the reproduction environment.

14. An apparatus comprising an interface system and a control system configured to perform the method of claim 1.

15. One or more non-transitory media having software stored thereon, the software including instructions for controlling one or more devices to perform the method of claim 1.

* * * * *